US009683417B2

(12) United States Patent
McKenzie

(10) Patent No.: US 9,683,417 B2
(45) Date of Patent: Jun. 20, 2017

(54) APPARATUS AND METHOD FOR HANDLING LIQUIDS OR SLURRIES FROM AN OIL OR GAS PROCESS

(71) Applicant: Romar International Limited, Ellon, Aberdeenshire (GB)

(72) Inventor: Martin McKenzie, Ellon, Aberdeenshire (GB)

(73) Assignee: Romar International Limited (GB)

( * ) Notice: Subject to any disclaimer, the term of this patent is extended or adjusted under 35 U.S.C. 154(b) by 367 days.

(21) Appl. No.: 14/414,629

(22) PCT Filed: Jul. 29, 2013

(86) PCT No.: PCT/GB2013/052030
§ 371 (c)(1),
(2) Date: Jan. 13, 2015

(87) PCT Pub. No.: WO2014/016624
PCT Pub. Date: Jan. 30, 2014

(65) Prior Publication Data

US 2015/0176352 A1 Jun. 25, 2015

(30) Foreign Application Priority Data

Jul. 27, 2012 (GB) ..... 1213458.1

(51) Int. Cl.
*E21B 21/06* (2006.01)
*B03C 1/24* (2006.01)
(Continued)

(52) U.S. Cl.
CPC ..... *E21B 21/065* (2013.01); *B03C 1/0332* (2013.01); *B03C 1/20* (2013.01);
(Continued)

(58) Field of Classification Search
CPC ..... E21B 1/065; B03C 1/24; B03C 1/0332; B03C 1/20; B03C 1/286; B03C 2201/20; B03C 2201/18
See application file for complete search history.

(56) References Cited

U.S. PATENT DOCUMENTS 2,738,876 A 3/1956 Thomas
3,476,232 A 11/1969 Merwin
(Continued)

FOREIGN PATENT DOCUMENTS

DE 8915615 11/1990
DE 4337484 3/1995
(Continued)

OTHER PUBLICATIONS

The Chapter II International Preliminary Report on Patentability for PCT/GB2013/052030, dated Jul. 24, 2014.*
(Continued)

*Primary Examiner* — David A Reifsnyder
(74) *Attorney, Agent, or Firm* — Workman Nydegger

(57) ABSTRACT

The invention provides an apparatus (10) for removing magnetic particles (53) from a liquid flowing from an oil or gas operation and method of use. The apparatus (10) comprises a plurality of magnet assemblies (20), each having a first condition in which an operable part is active to attract magnetic particles (53) to the magnet assembly (20), and a second condition in which the operable part is inactive and magnetic particles (53) are not attracted to the magnet assembly (20). A drive mechanism (13) moves the magnet assemblies (20) between exposure to a flow path of from a liquid (40) flowing from an oil or gas operation and a collection location (54). An activation means (36) moves the magnet assemblies (20) between the first condition and the second condition.

50 Claims, 20 Drawing Sheets

(51) Int. Cl.
*B03C 1/033* (2006.01)
*B03C 1/20* (2006.01)
*B03C 1/28* (2006.01)

(52) U.S. Cl.
CPC ..... *B03C 1/24* (2013.01); *B03C 1/286* (2013.01); *B03C 2201/18* (2013.01); *B03C 2201/20* (2013.01)

(56) References Cited

U.S. PATENT DOCUMENTS

| | | | |
|---|---|---|---|
| 4,457,838 | A | 7/1984 | Carr |
| 6,056,879 | A | 5/2000 | Schaaf |
| 6,355,176 | B1 | 3/2002 | Schaaf |
| 2005/0045547 | A1 | 3/2005 | Anderson |
| 2009/0200220 | A1 | 8/2009 | Mckenzie |
| 2011/0203976 | A1 | 8/2011 | Baker |

FOREIGN PATENT DOCUMENTS

| | | |
|---|---|---|
| DE | 102006046356 | 4/2008 |
| EP | 0532136 | 3/1993 |
| EP | 1123741 | 8/2001 |
| EP | 2436449 | 4/2012 |
| WO | WO2007023276 | 3/2007 |
| WO | WO2014016624 | 1/2014 |

OTHER PUBLICATIONS

International Search Report and Written Opinion for PCT/GB2013-052030.

* cited by examiner

APPARATUS AND METHOD FOR HANDLING LIQUIDS OR SLURRIES FROM AN OIL OR GAS PROCESS

CROSS-REFERENCE TO RELATED APPLICATIONS

This application claims priority to and the benefit of PCT Application No. PCT/GB2013/052030, filed Jul. 29, 2013, entitled "APPARATUS AND METHOD FOR HANDLING LIQUIDS OR SLURRIES FROM AN OIL OR GAS PROCESS", which claims the benefit of and priority to Great Britain Patent Application No. 1213458.1, filed Jul. 27, 2012, each of which is incorporated herein in its entirety.

The present invention relates to an apparatus and method for handling oil and gas process liquids or slurries. In particular, the invention in one of its aspects relates to an apparatus for handling liquids or slurries flowing from a wellbore operation which contain magnetic particles or swarf and a method of use of such apparatus. One aspect of the invention relates to an apparatus for and method of removing magnetic swarf from a liquid flowing from an oil or gas operation.

BACKGROUND TO THE INVENTION

In the oil and gas exploration and production industry, it is common to cut, mill, grind or drill through steel components such as casing in an installed wellbore, for example to form a window in the wellbore to allow a sidetrack well to be drilled. The material removed by this process (referred to as swarf) is mixed with the drilling fluid (or mud), which is circulated through the wellbore and returned to surface via the wellbore annulus along with the drill cuttings. It is desirable to process the drilling mud returns to remove the drill cuttings for treatment and disposal, and to prepare the drilling mud for recirculation. The swarf is highly erosive and must be removed from the valuable drilling mud to allow it to be reused safely. However, significant quantities of swarf in drilling mud returns may interfere with or damage surface flow equipment including equipment used for the separation of solid particles (such as drill cuttings or rock fragments), presenting the operator with an additional problem.

The ferrous nature of swarf has led to proposals to use magnetic fields to separate the swarf from the fluid. U.S. Pat. No. 3,476,232 describes an apparatus for batch treatment of drilling fluid, which includes a series of magnetic bars on a conveyor inside a casing. The magnetic bars lift the swarf from a vessel and cause it to be dropped in a collection chamber. The U.S. Pat. No. 3,476,232 apparatus has a geometry which provides only low magnetic field penetration into the liquid. It is slow in operation and is limited in its application to the treatment of a flowing liquid. U.S. Pat. No. 3,476,232 does not provide a means for separating non-magnetic solid particles from the liquid to be treated.

US 2005/0045547 describes a magnetic separator apparatus which has a pair of conveyor chains from which are suspended frames with spaced-apart magnetic rods. The magnetic rods hang vertically in the liquid as the chains follow their path through the liquid, and the liquid in the tank flows through the frames. The rods are cleaned at a wiping station.

DE 4337484 and EP 0532136 describe magnet separator systems which include a series of circulating magnetic rods driven by chains through a liquid. At a collection location, wipers for the magnetic rods are activated to remove accumulated magnetic particles.

U.S. Pat. No. 6,355,176 describes an assembly and method for collecting and releasing magnetic materials which includes elongated permanent magnets arranged to cyclically move through a tank of liquid and be moved to a collection location at which the magnets are separated from their covers.

WO 07/23276, filed by the present applicant, describes an improved apparatus which uses a series of pipes which contain circulating magnetic chains. The pipes pass through a channel through which swarf-containing drilling mud flows from a drilling operation. The magnetic chains attract the particles to the outside of the pipe, and transport them along the pipe until they are released into a collection chamber. The apparatus may be used in conjunction with an array of elongate magnets located in housings which are supported in a partially submerged position in the flow channel. Swarf particles are attracted to the outside of the housings, which may be removed from the flow channel. Displacement of the magnet with respect to the housing releases the swarf particles into a collection chamber.

The arrangement of WO 07/23276 improves upon U.S. Pat. No. 3,476,232 and other previously proposed systems by virtue of its geometry, reliability and configurability, and has been successfully used in commercial applications. However, it does not provide a mechanism for the separation of non-magnetic solid particles from a drilling fluid. In addition, it is generally desirable to increase the exposure of the flowing liquid to a magnetic field; increase the flow rate of fluid that may pass through the apparatus; and reduce the size or footprint of the apparatus for offshore use.

It is therefore an aim of the present invention to provide an apparatus for handling oil and gas process liquids or slurries and a method of use which addresses one or more drawbacks or deficiencies of the previously proposed apparatus and methods.

One aim of the invention is to provide an improved apparatus for and method of removing magnetic swarf particles from an oil or gas process liquid (such as drilling mud). An additional aim is to provide an apparatus for and method of separating non-magnetic and magnetic swarf particles from a liquid flowing from an oil or gas operation (such as drilling mud).

Additional aims and objects of the invention will become apparent from reading the following description.

SUMMARY OF THE INVENTION

According to a first aspect of the invention, there is provided an apparatus for removing magnetic particles from a liquid from an oil or gas operation, the apparatus comprising:

- a plurality of magnet assemblies, each magnet assembly having a first condition in which an operable part of the magnet assembly is active to attract magnetic particles to the magnet assembly, and a second condition in which the operable part of the magnet assembly is inactive and magnetic particles are not attracted to the magnet assembly;
- a drive mechanism for moving the magnet assemblies between exposure to a liquid from an oil or gas operation and a collection location;
- and an activation means which moves the magnet assemblies between the first condition and the second condition.

Preferably, a magnet assembly is in the first condition when exposed to the liquid. More preferably, the magnet assembly is in the second condition when the magnet assembly is at the collection location.

Preferably the drive mechanism cyclically moves the plurality of magnet assemblies between exposure to the liquid and the collection location. More preferably, the magnet assemblies are arranged in a continuous loop, chain or conveyor, which may be circulated or cycled.

Preferably, the magnet assembly comprises a housing and a magnet. The housing and/or the magnet may be elongate. Preferably, the housing is an elongate housing oriented in a direction perpendicular to a direction of movement of the magnet assembly. More preferably the magnet is an elongate magnet oriented in a direction perpendicular to a direction of movement of the magnet assembly.

The activation means is preferably a mechanism which moves a magnet contained in the magnet assembly relative to the magnet assembly. The magnet may be movable in the relative to the housing, and preferably is movable in the housing. Preferably the magnet is movable relative to the housing in a direction perpendicular to the movement of the magnet assemblies. Such an arrangement provides the advantage that the movement of the magnet assemblies may be used to mechanically convey solid particles which are non-magnetic.

The drive mechanism may cause operation of the activation means. For example, the movement of a magnet assembly between exposure to the liquid and the collection location may cause the activation means to be operated. In this way, cyclical movement of the magnet assembly causes cyclical operation of the activation means, and therefore cyclical activation and deactivation of the attractive force for the magnetic particles. In this way, the magnet assemblies may be cyclically caused to release the magnetic particles from the magnet assemblies when at the collection location.

In one embodiment, a first part of the housing forms the operable part of the magnet assembly, and the operable part of the magnet assembly may be separated from the activation means. This separation facilitates embodiments in which the magnet of a magnet assembly is movable relative to the housing in a direction perpendicular to the movement of the magnet assemblies.

The activation means may comprise a mechanism for imparting a sliding motion to a magnet, relative to a housing of the magnet assembly, and may comprise a guide and formation for engaging the guide. The formation may comprise a cam or bearing. The guide may be a rail or a slot.

In one embodiment, the housing is a tubular, which may be formed from a non-ferrous material such as stainless steel. The magnet may be slidably mounted in the tubular. A formation on the magnet may contact a guide, such that movement of the magnet assembly in a direction inclined to the guide causes the magnet to slide in the housing. The housing may comprise a slot through which the formation extends.

The plurality of magnet assemblies may be arranged in an array or layer, which may located to contact the liquid. The magnet assemblies may be spatially separated to provide flow spaces between adjacent magnet assemblies.

In another embodiment, the magnet assemblies may be arranged substantially horizontally and may define a substantially vertical flow path therethrough. The liquid may be gravity fed through the plurality of magnet assemblies.

The magnet assemblies may define an array or layer which traverses a flow path of the liquid.

Where the magnet assemblies are arranged in a continuous circle, loop, chain or conveyor, the magnet assemblies may define two arrays or layers which may traverse the flow path. Preferably the magnet assemblies of the first and second arrays or layers are in the first (active) condition where they traverse the flow path.

The plurality of magnet assemblies may be arranged as a conveyor for solid particles. Thus the solid particles resting on the plurality of the magnet assemblies may be carried or mechanically conveyed to a collection location (which may the collection location for the magnetic particles or may be a second collection location).

The apparatus may comprise a dividing screen separating the operable parts of the magnet assemblies from the activation means. The screen may comprise one or more sheets, oriented in a plane aligned in the direction of movement of the magnet assemblies. The magnet assemblies may extend through a slot in the dividing screen. The magnet assemblies may comprise one or more plates covering the slot in the dividing screen, and may comprise a pair of plates, each plate of the pair on opposing sides of the screen. Adjacent plates on adjacent magnet assemblies may be arranged to overlap one another. The plates may be rectangular or square, although other shaped including polygons, ellipses and circles may also be used. Preferably, the apparatus comprises first and second dividing screens which are spatially separated.

Adjacent magnets in adjacent magnet assemblies may be arranged with opposing poles facing one another. Alternatively, the poles of the magnets are arranged vertically. Magnetic flux may then be oriented vertically from the magnet assemblies at a location close to a surface of the magnet assembly. This arrangement may cause each adjacent pair of magnet assemblies to generate first and second magnetic fields: one upper field and one lower field (with the opposite field direction). Such a configuration is preferred as it reduces the likelihood of magnetic particles blocking the flow space between the adjacent magnet assemblies.

In one embodiment of the invention, the apparatus comprises a conveyor path and/or arrangement of magnet assemblies which is rotationally symmetrical. The magnet assemblies and/or a housing thereof may be fixed with respect to a dividing screen, bulkhead or bulkhead member. The apparatus may therefore be sealed against the passage of fluid and/or swarf from the operating side of the apparatus.

The apparatus may comprise a substantially circular conveyor path and/or arrangement of magnet assemblies.

The apparatus may comprise an inlet for delivering a liquid from an oil or gas operation to an interior of the conveyor path. The apparatus may comprise a fluid outlet for receiving fluid from an exterior of the conveyor path. The apparatus may comprise a collection chute configured to receive solids and/or magnetic swarf particles, and the collection chute may be located at least partially in the interior of the conveyor path. The collection chute may located at an upper segment of the conveyor path, and/or may be located at a position higher than or above the inlet.

The apparatus may comprise a formation for mechanically moving or lifting solid particles towards a collection location. The formation may comprise one or more fingers.

According to a second aspect of the invention, there is provided a method of removing magnetic particles from a liquid from an oil or gas operation, the method comprising:

providing a plurality of magnet assemblies;

exposing the plurality of magnet assemblies to a liquid from an oil or gas operation while a subset of the magnet assemblies is in a first condition in which an operable part of the magnet assembly is active to attract magnetic particles to the magnet assembly;

moving the magnet assemblies to a collection location;

activating the magnet assemblies to move the magnet assemblies to a second condition in which the operable part of the magnet assembly is inactive and magnetic particles are not attracted to the magnet assembly to release the magnetic particles to a collection device.

The method may comprise cyclically moving the magnet assemblies between exposure to the liquid and the collection location, and may comprise cyclically moving the magnet assemblies between the first and second conditions.

The method may comprise conveying solid particles to the collection location.

The method may comprise rotating a rotary assembly comprising the magnet assemblies.

The method may comprise moving the magnet assemblies in a continuous loop, chain or conveyor, which may be circulated or cycled.

The method may comprise moving the magnet assembly in a direction perpendicular to a direction of an elongate axis of the magnet assembly.

The activation means is preferably a mechanism which moves a magnet contained in the magnet assembly relative to the magnet assembly. The magnet may be movable in the relative to the housing, and preferably is movable in the housing. The method may comprise moving the magnet relative to the housing in a direction perpendicular to the movement of the magnet assembly.

The method may comprise imparting a sliding motion to a magnet, relative to a housing of the magnet assembly. In one embodiment, The method may comprise contacting a formation on the magnet with a guide, such that movement of the magnet assembly in a direction inclined to the guide causes the magnet to slide in the housing.

The method may comprise arranging the magnet assemblies substantially horizontally and passing the liquid through a substantially vertical flow path between the magnet assemblies. The liquid may be gravity fed through the plurality of magnet assemblies.

The method may comprise carrying or mechanically conveying solid particles towards a collection location (which may the collection location for the magnetic particles or may be a second collection location).

The method may comprise mechanically moving or lifting solid particles towards a collection location by a formation of the apparatus. The formation may comprise one or more fingers.

Embodiments of the second aspect of the invention may include one or more features of the first aspect of the invention or its embodiments, or vice versa.

According to a third aspect of the invention, there is provided a method of removing magnetic particles from a liquid flowing from an oil or gas operation, the apparatus comprising:

providing a plurality of magnet assemblies;

exposing the plurality of magnet assemblies to a flow path of a liquid flowing from an oil or gas operation while a subset of the magnet assemblies is in a first condition in which an operable part of the magnet assembly is active to attract magnetic particles to the magnet assembly;

using a drive mechanism to move the magnet assemblies to a collection location;

using an activation means to move the magnet assemblies to a second condition in which the operable part of the magnet assembly is inactive and magnetic particles are not attracted to the magnet assembly;

releasing the magnetic particles to a collection device.

Embodiments of the third aspect of the invention may include one or more features of the first aspect or second aspects of the invention or their embodiments, or vice versa.

According to a fourth aspect of the invention, there is provided an apparatus for removing magnetic particles from a liquid flowing from an oil or gas operation, the apparatus comprising:

a conveyor comprising a plurality of magnet assemblies defining an array which traverses a flow path of a liquid from an oil or gas operation, each magnet assembly having a first condition in which an operable part of the magnet assembly is active to attract magnetic particles to the magnet assembly, and a second condition in which the operable part of the magnet assembly is inactive and magnetic particles are not attracted to the magnet assembly;

a drive mechanism for moving the magnet assemblies between a position in which they are exposed to the liquid and a collection location;

wherein movement of the magnet assemblies mechanically conveys solid particles in the liquid to the collection location;

and wherein the apparatus comprises an activation means which moves the magnet assemblies between the first condition when exposed to the liquid and the second condition when at the collection location.

Embodiments of the fourth aspect of the invention may include one or more features of the first to third aspects of the invention or their embodiments, or vice versa.

According to a fifth aspect of the invention, there is provided a method of removing magnetic particles from a liquid flowing from an oil or gas operation, the apparatus comprising:

providing a conveyor comprising a plurality of magnet assemblies which define an array which traverses a flow path of a liquid from an oil or gas operation;

exposing the conveyor to the flow path of the liquid while a subset of the magnet assemblies is in a first condition in which an operable part of the magnet assembly is active to attract magnetic particles to the magnet assembly;

using a drive mechanism to move the magnet assemblies between a position in which they are exposed to the liquid and a collection location;

moving the magnet assemblies to mechanically convey solid particles in the liquid to the collection location;

using an activation means to move the magnet assemblies to a second condition in which the operable part of the magnet assembly is inactive and magnetic particles are not attracted to the magnet assembly; and releasing the magnetic particles to a collection device.

Embodiments of the fifth aspect of the invention may include one or more features of the first to fourth aspects of the invention or their embodiments, or vice versa.

According to a sixth aspect of the invention, there is provided an oil or gas exploration or production facility comprising the apparatus of the first or fourth aspects of the invention or their embodiments.

According to a particular aspect of the invention, there is provided an apparatus for removing magnetic particles from a liquid flowing from an oil or gas operation, the apparatus comprising:

a plurality of magnet assemblies, each magnet assembly having a first condition in which an operable part of the magnet assembly is active to attract magnetic particles to the magnet assembly, and a second condition in which the operable part of the magnet assembly is inactive and magnetic particles are not attracted to the magnet assembly;

a drive mechanism for moving the magnet assemblies between a position in which they are exposed to the liquid and a collection location;

wherein the apparatus comprises an activation means which moves the magnet assemblies between the first condition when exposed to the liquid and the second condition when at the collection location;

and wherein the apparatus comprises a dividing screen separating the operable parts of the magnet assemblies from the activation means.

The magnet assemblies may be operable to be activated by moving a magnet of a magnet assembly from one side of the dividing screen to an opposing side of the dividing screen.

The screen may comprise one or more sheets, oriented in a plane aligned in the direction of movement of the magnet assemblies.

Embodiments of this particular aspect of the invention may include one or more features of the first to sixth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1A:
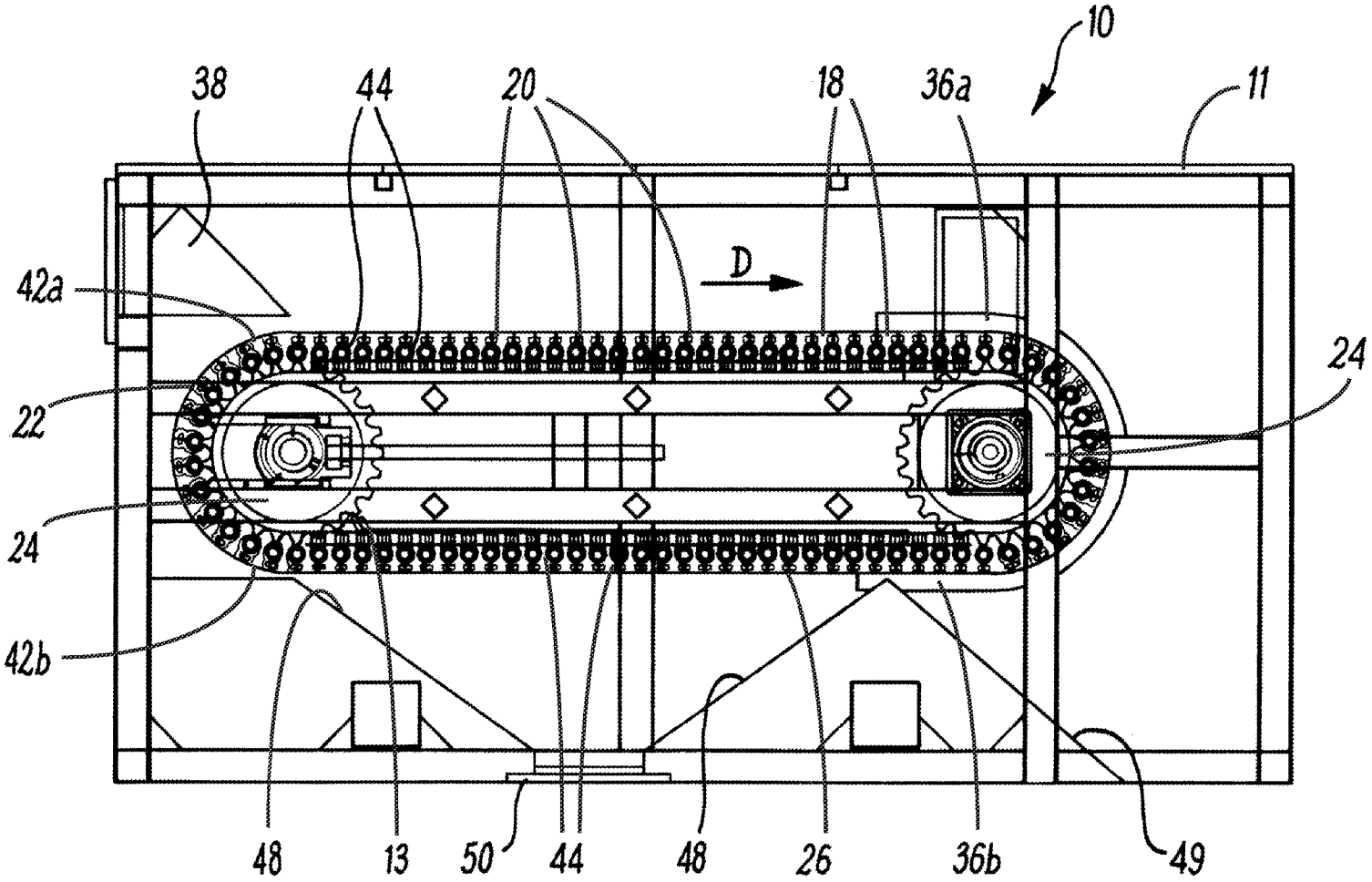
FIG. 1A is a schematic, side view of a drive side of an apparatus in accordance with a first embodiment of the invention.

Referring firstly to FIGS. 1A to 1C and FIG. 2, there is shown an apparatus, generally depicted at 10, according to an exemplary embodiment of the invention. The apparatus 10 is configured to handle drilling mud from a hydrocarbon drilling operation, and is designed to separate drilling mud, large non-magnetic solid particles, and small magnetic particles (swarf). The apparatus 10 comprises a frame 11 having drive side 12, which comprises a drive mechanism 13 and activation means for the functioning of the apparatus, and an operating side 14, which receives and processes a liquid to be treated. A bulkhead assembly 16, consisting of two bulkhead members 16*a*, 16*b*, separates the drive side 12 from the operating side 14.

The apparatus 10 has a number of magnet assemblies 20, arranged as a continuous conveyor 22 around a pair of drive wheels 24. The magnet assemblies 20 are coupled to a pair of chains 26 which are driven by the wheels 24, so that in use the magnet assemblies are cyclically moved around the apparatus 10. The magnet assemblies extend through a slot in the bulkhead assembly 16, from the drive side to the operating side. Each magnet assembly is provided with plates 18, located on opposing sides of the bulkhead members 16*a*, 16*b*, to cover the slot in the bulkhead and prevent the unwanted passage of mud from the operating side to the drive side.

The apparatus comprises an inlet 38 which delivers drilling mud or slurry to the operating side 14 of the apparatus. Flow plates 48 are arranged to divert drilling model slurry to outlet 50. A collection flow plate 49 is arranged to direct magnetic particles removed from the drilling slurry to a collection skip (not shown). It will be appreciated that in alternative embodiments of the invention the collection skip and the tank may be part of an integrated assembly. In a further alternative, the outlet 50 may be coupled to a conduit or arranged over a flow channel to direct processed drilling mud or slurry towards a tank displaced from the apparatus, or to allow the apparatus to be used as part of a continuous flow process without a dedicated tank for receiving the processed mud or slurry.

Figure 1B:
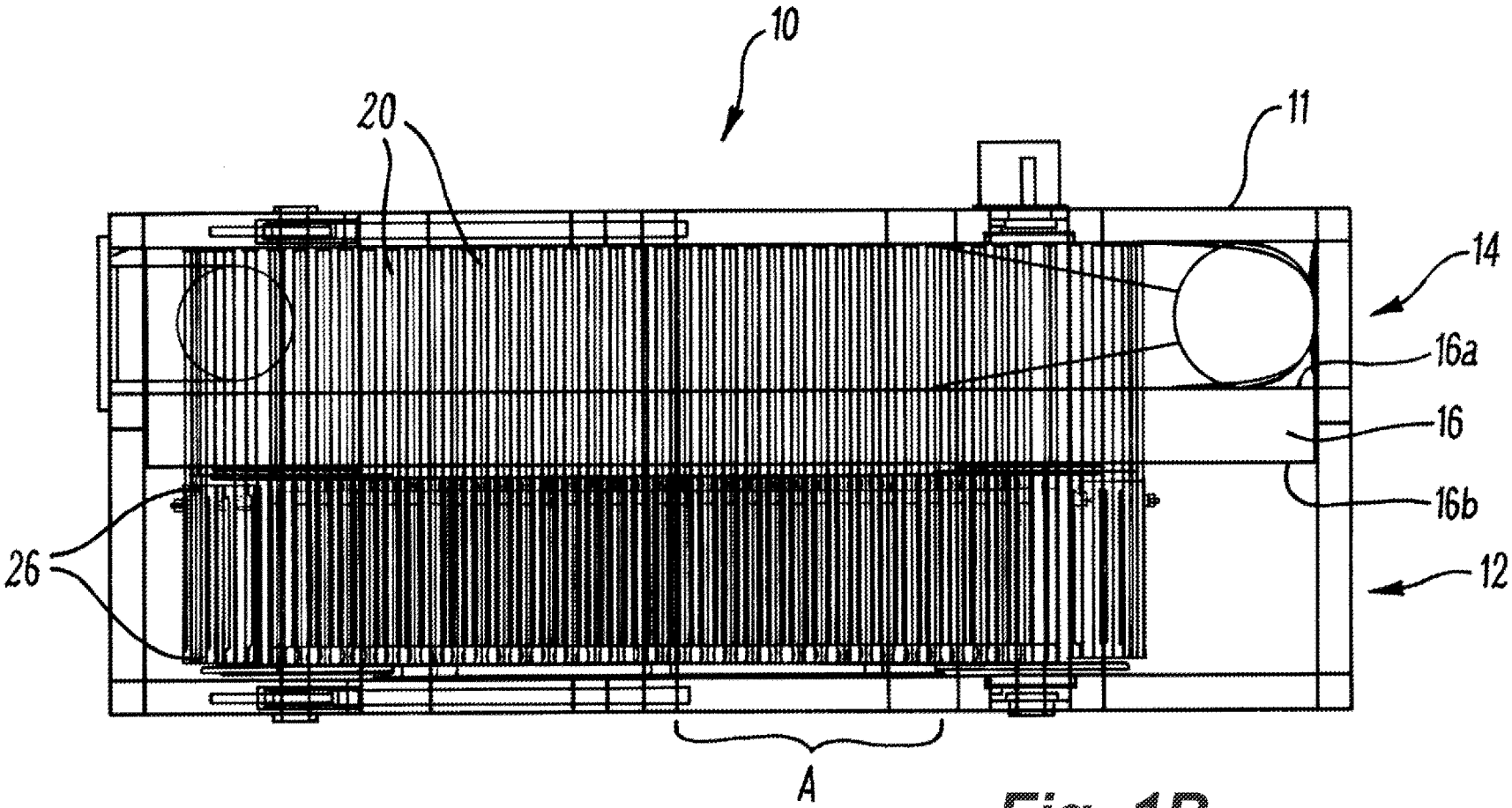
FIG. 1B is a schematic, plan view of the apparatus of FIG. 1A.
Figure 1C:
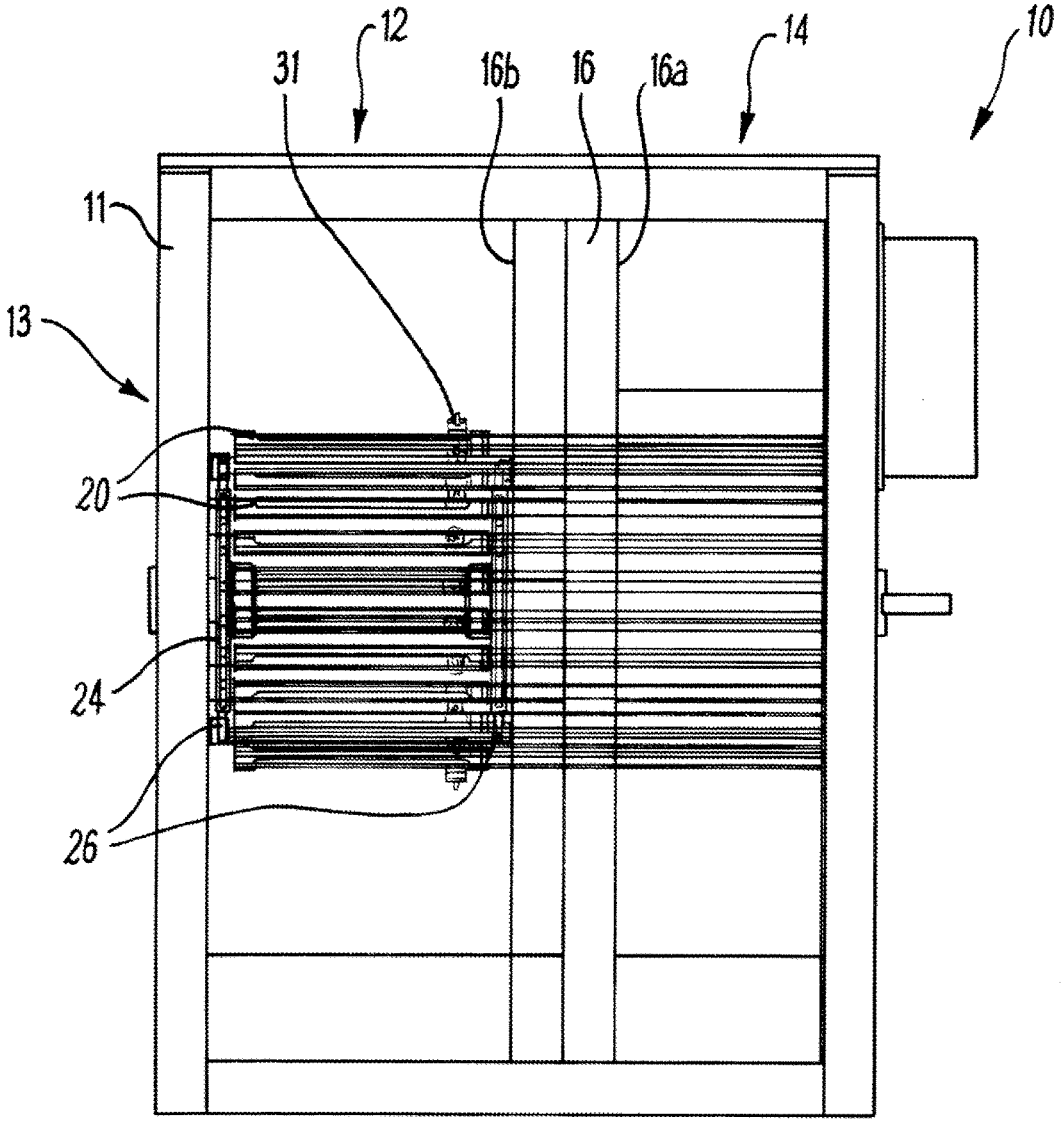
FIG. 1C is a schematic, end view of the apparatus of FIGS. 1A and 1B.
Figure 2:
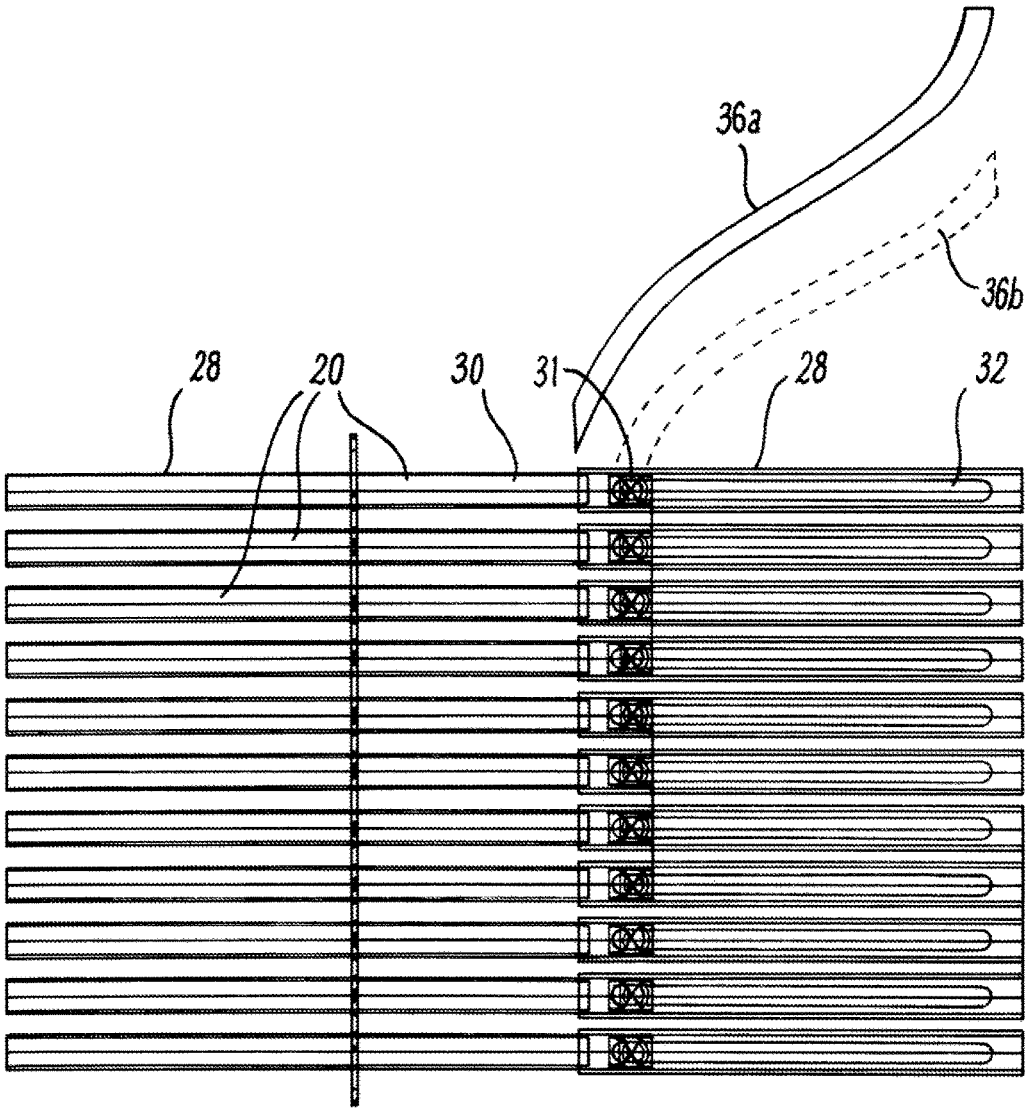
FIG. 2 is a schematic, plan view of selected components of the apparatus of FIGS. 1A to 1C which demonstrate a principle of operation.

FIG. 2 is an enlarged view of a series of magnet assemblies 20, shown at region A in FIG. 1B. Each magnet assembly 20 comprises a tubular housing 28 (in this example, cylindrical) formed from stainless steel, and an internal elongate magnet 30, slidable in the housing 28. Each magnet 30 comprises a formation 31 which protrudes through a slot 32 in the housing. In this case, the formation is a bearing 34, arranged to engage with a guide rail assembly 36 to slide the magnet within the housing. The apparatus comprises a pair of guide rails; 36*a* retracts the magnets from the operating side 14, and 36*b* extends the magnets into the operating side 14.

Figure 3A:
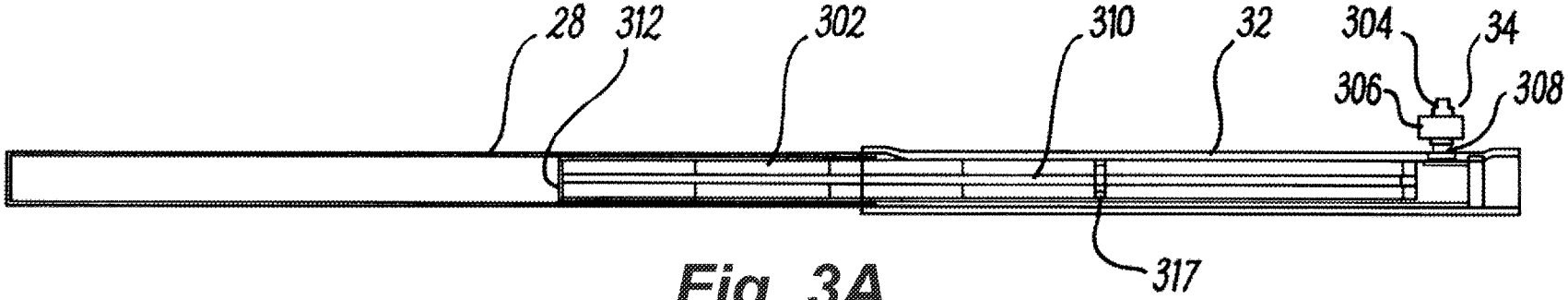
FIGS. 3A and 3B are longitudinal-sectional and cross-sectional views of a magnet and bearing according to an embodiment of the invention.
Figure 3B:
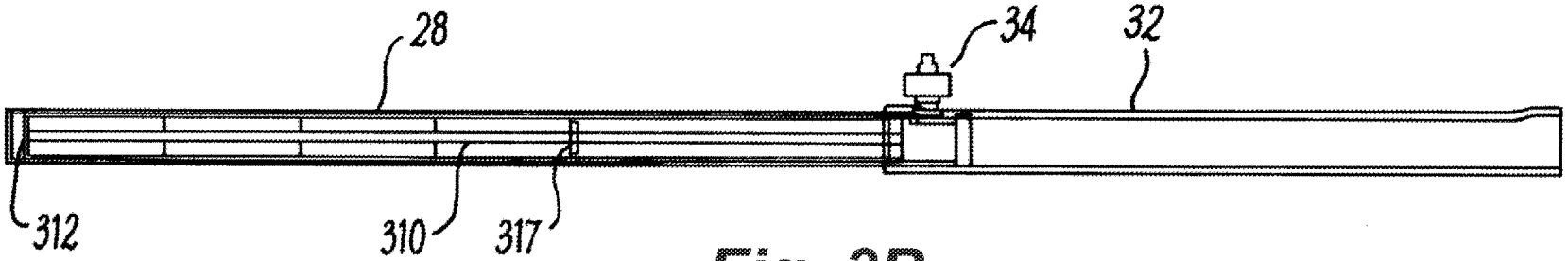
Figure 4:
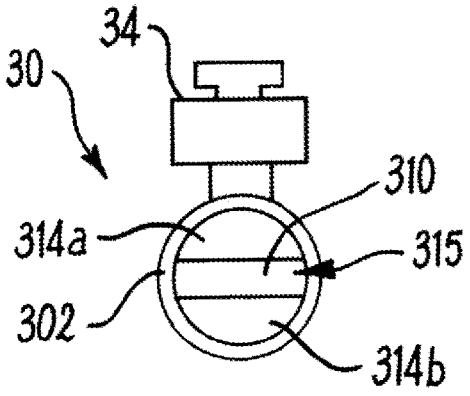
FIG. 4 is a cross-sectional view of a magnet and bearing according to an embodiment of the invention.

Referring now to FIGS. 3A, 3B and 4, there is shown a magnet assembly in sectional views. FIG. 3A is a longitudinal section of an assembly in a retracted position, and FIG. 3B is a longitudinal section of the magnet assembly in an extended position. FIG. 4 is a part cross-sectional view through a magnet of the assembly.

The magnet assembly 20 comprises a tubular housing 28, and an elongated magnet 30 shaped and sized to fit within the housing. The magnet 30 comprises a cylindrical casing section 302 and a bearing assembly 34. The bearing assembly comprises a pin 304, and a bearing head 306, designed to roll smoothly against the guide 36. A neck portion 308 is sized to extend through the slot 32 on the magnet assembly housing 28. Within the casing is a pole piece 310, which extends from the bearing assembly 34 to the opposing end 312 of the magnet. The pole piece 310 is a planar member mounted substantially centrally in the vertical dimension of the magnet 30. Along the length of the magnet, upper and lower part cylindrical portions 314*a*, 314*b* of magnetic material form the magnet body 315, which is adhered into the casing 302 and to the pole piece 310. A roll pin 317 prevents the magnet body from sliding outwards from the magnet 30 in the event that the adhesive degrades.

Figure 5:
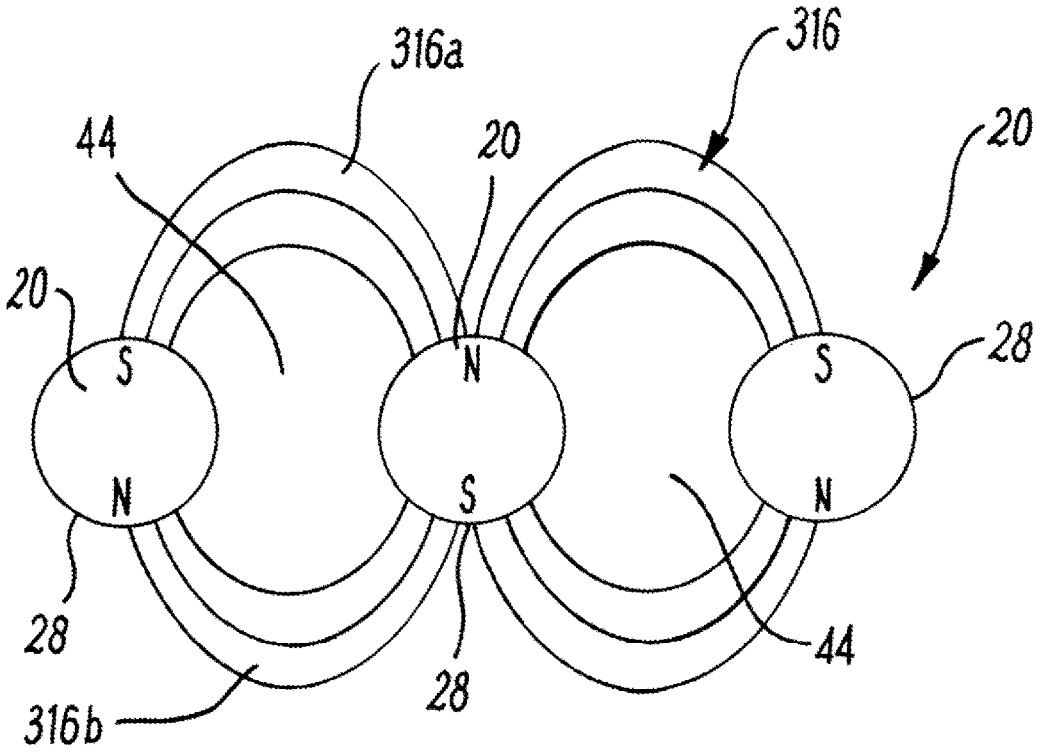
FIG. 5 is a schematic representation of the magnetic flux pattern with a magnet configuration according to an embodiment of the invention.

When assembling the apparatus 10, the magnets are oriented with the poles arranged vertically, with adjacent magnets oriented in opposing directions, as shown schematically in FIG. 5. The magnetic flux 316 is arranged in upper and lower patterns 316*a*, 316*b*. This orientation tends to cause magnetic particles to form on the upper or lower surfaces of the housings 28, and reduces the tendency for magnetic particles to build up in the central area and block the flow space 44. The bearing assembly 34 keeps the magnets in the preferred orientation (i.e. prevents rotation which would bring the north and south poles together).

Figure 6A:
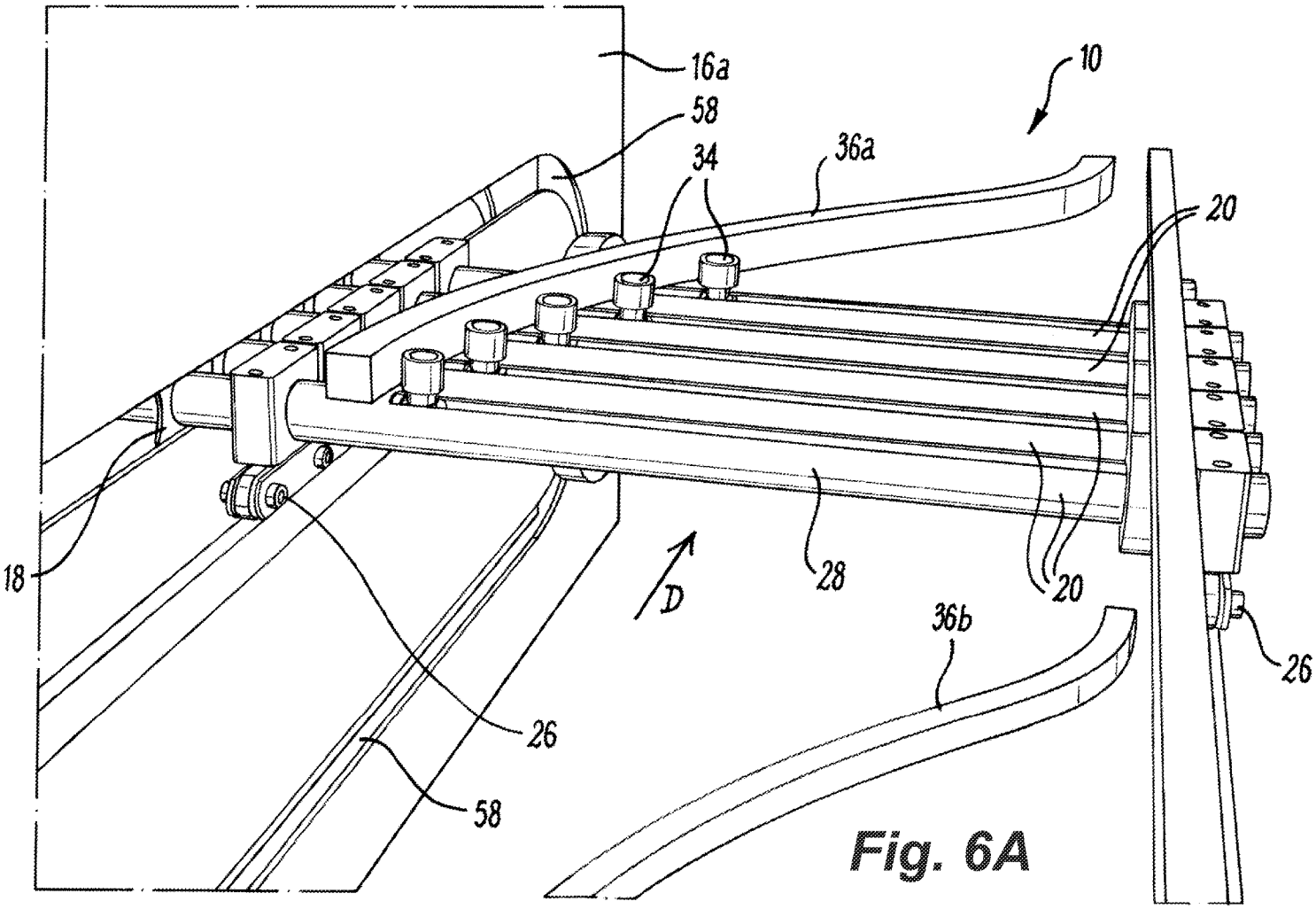
FIGS. 6A and 6B are perspective views of selected components of the embodiment of FIG. 1 and their interaction.
Figure 6B:
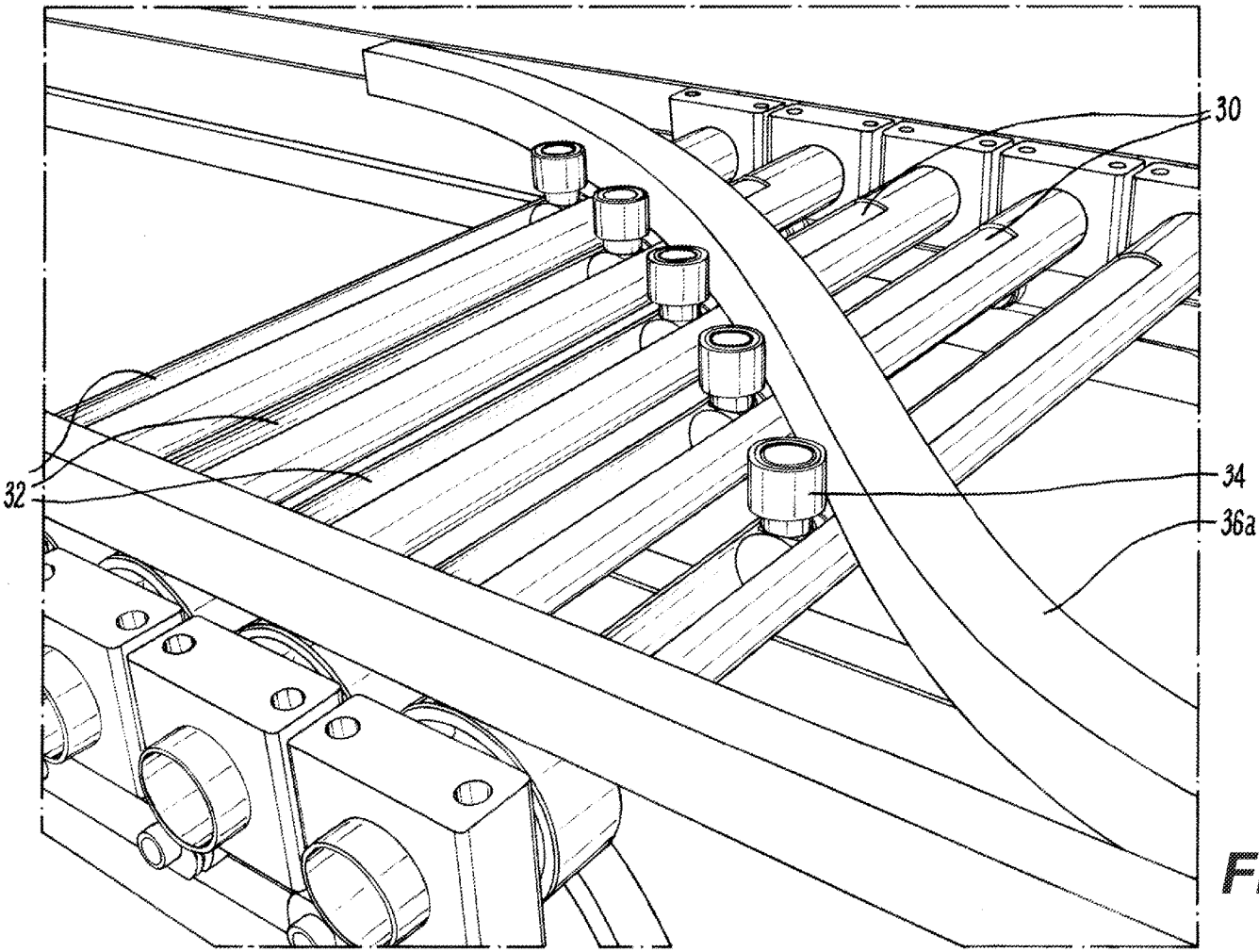

FIGS. 6A and 6B are perspective views which assist with understanding of the configuration of components of the embodiment of FIGS. 1 to 4 and their interaction. FIG. 6A is a view of the drive side 12 of the apparatus 10 with various components removed for simplicity. The drawing shows five magnet assemblies 20 with their respective magnets 30 and bearings 34 interacting with the upper guide rail 36*a*. The drawing shows the bulkhead 16*a* with a slot 58 corresponding to the direction of travel of the magnet assemblies, along with components of the drive chain 26. FIG. 6B shows the slots 32 in the magnet assembly housings 28, and the magnets 30 with the bearings 34.

Figure 7:
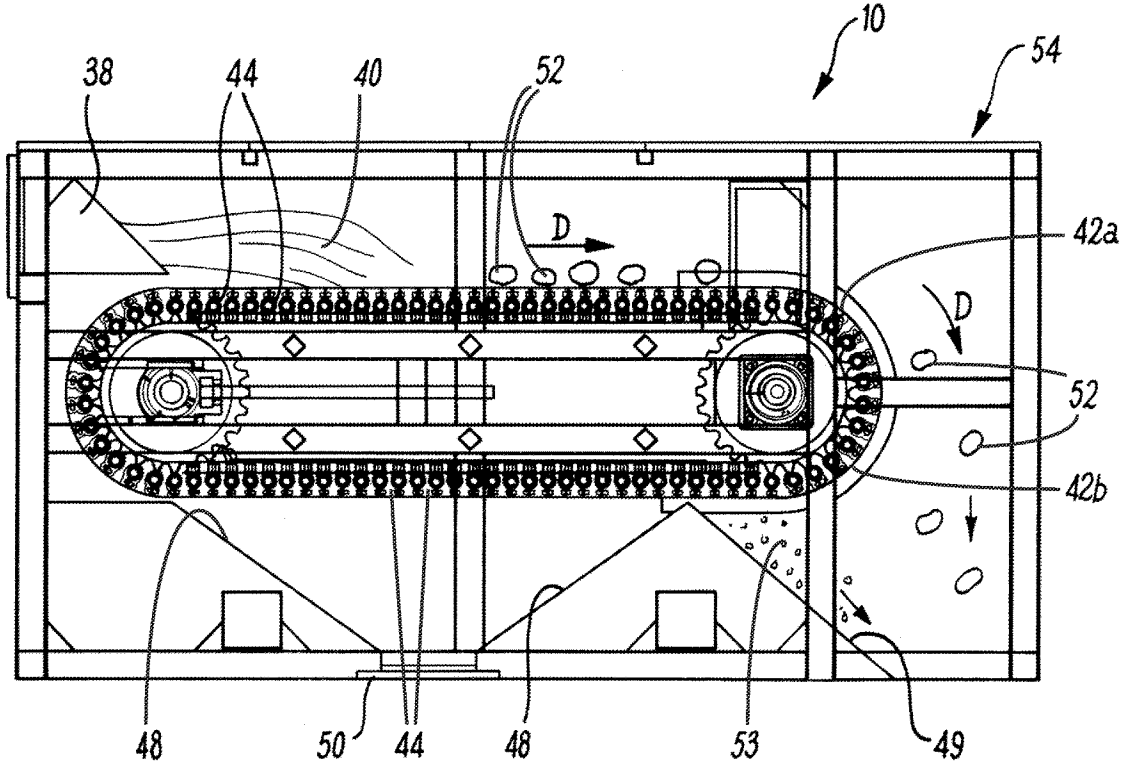
FIG. 7 is a schematic side view of the apparatus of FIG. 1 in operation.

Before describing the details of this embodiment of the invention, the basic principles of operation will be described with reference to the foregoing drawings and FIG. 7, which is a schematic view of the apparatus 10 in use. The apparatus 10 is arranged above a tank (not shown) which is arranged to receive drilling mud or slurry from the outlet 50. A skip (not shown) is provided to receive solid particles and magnetic particles removed from the drilling mud or slurry during processing as will be described below. It will be appreciated that in alternative embodiments of the invention the apparatus multiple skips may be provided or the apparatus may be provided with integral collection bins.

The drive mechanism 13 is switched on to cause the conveyor to run and move the magnet assemblies in the direction D. Inlet 38 delivers drilling mud or slurry 40 to the operating side 14 of the apparatus. Gravity directs the flow of mud towards an upper layer 42*a* of the conveyor 22, where it impinges on the magnet assemblies 20. Flow spaces 44 between adjacent magnet assemblies allow the mud to pass downwards towards the second lower layer 42*b*, where it impinges on the magnet assemblies 20 again, and flows through the flow spaces 44 to a mud receptacle 46. Flow plate 48 diverts mud towards the mud receptacle 46 and outlet 50, from which the processed mud is recovered.

As the mud passes through the apparatus 10, large solid particles 52 are prevented from passing through the flow spaces 44, and are conveyed with movement of the conveyor 22 to a collection end 54 of the apparatus where they are received in a collection skip (not shown). The swarf particles in the mud are attracted to the surface of the housings 28 of the magnet assemblies 20 and are carried on the outer surface of the housing towards the collection end 54. As each magnet assembly approaches the collection end 54, the bearings 34 of the magnet assemblies 20 contact the guide rail 36*a*, and continued movement of the magnet assemblies causes the magnets 30 to slide in the housings 28 away from the operating side 14, so that it is retracted into the drive side 12. The magnetic field is therefore deactivated from the operating side, and the attractive force which retained the swarf particles on the magnet assemblies is no longer present. The magnetic particles 53 fall by gravity towards the flow plate 49 and into the collection skip.

When the magnet assemblies reaches the lower layer 42*b* on the return cycle, their bearing assemblies 34 contact the guide rail 36*b*, and are forced to slide back inside the housing to extend into the operative part of the housing. Here it provides an attractive force for magnetic particles passing through the apparatus which were not collected by the upper layer 42*a*. Continued operation causes the magnet assemblies to driven to be cycled back to the upper layer 42*a* and the process is repeated.

The apparatus 10 as described above functions to collect magnetic particles on the magnet assemblies and automatically remove the particles from the magnet assemblies at a collection location. The magnet assemblies 20 undergo a cyclical motion, and during a cycle, each magnet assembly is activated and deactivated to cause attraction and release of magnetic particles contained in the fluid being processed.

The apparatus has the additional benefit that solid particles which are too large to pass through the flow spaces between adjacent magnet assemblies are conveyed by the cyclical movement to a collection location. The apparatus is therefore capable of dealing with liquids or slurries containing high proportions of solids as well as magnetic swarf particles.

Figure 8A:
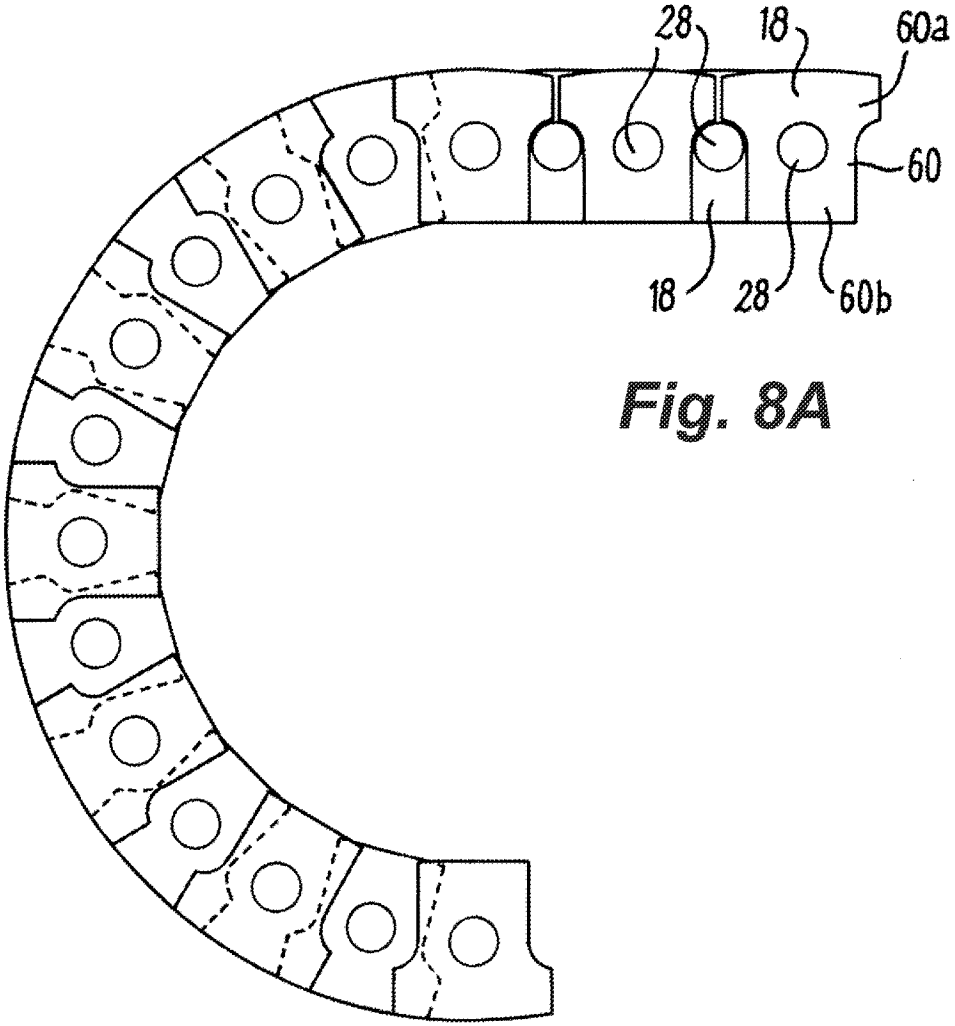
FIGS. 8A and 8B are respectively schematic side and plan views of an arrangement of plates as may be used with embodiments of the invention.
Figure 8B:
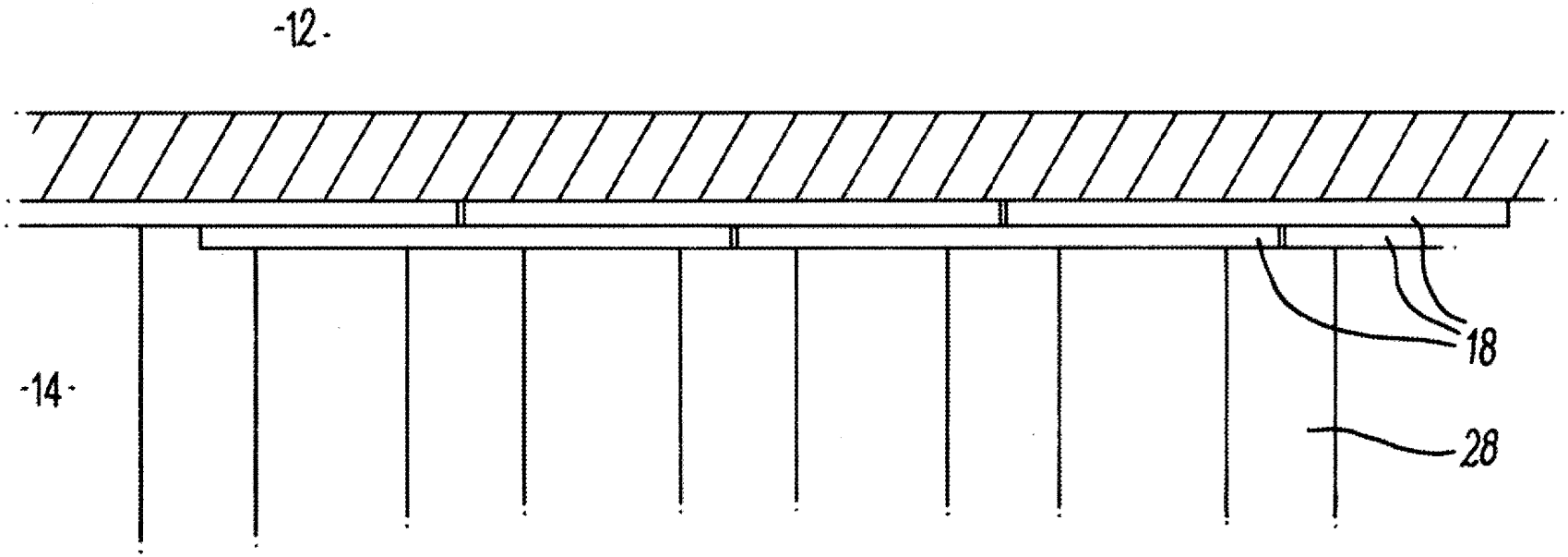

In the above-described embodiment an arrangement of plates 18 is provided on the magnet assemblies in order to mitigate against unwanted passage of mud and magnetic swarf particles from the operating side 14 of the apparatus to the drive side 12. FIGS. 8A and 8B show schematically an arrangement of plates 18 according to one embodiment of the invention. Each plate 18 is welded onto the tubular member 28 of a magnet assembly 20 and provides an extended flange portion 60 in a radial direction from the magnet assembly. Each plate 18 in this embodiment comprises an outer portion 60*a*, arranged generally towards the outside of the loop created by the conveyor path and an inner portion 60*b* arranged generally towards the inside of the loop created by the conveyor path. The outer portion 60*a* is wider than the inner portion 60*b*, and in this case extends towards the approximate mid-point of an adjacent magnet assembly. The wider outer portion provides improved coverage of the slot in the bulkhead as the assemblies separate as they follow the curved path of the conveyor loop. As the magnet assemblies follow the curved path, the increased separation of the outer portion does not create a gap; the separation is covered by the increased radial dimension of the plate 18.

In this embodiment, the plates 18 are arranged in two layers, shown most clearly in FIG. 8B, which overlap to provide complete coverage of the slot and ensure a convoluted path through the plates. The plates may be described as having a "T-shirt" shape.

Figure 9:
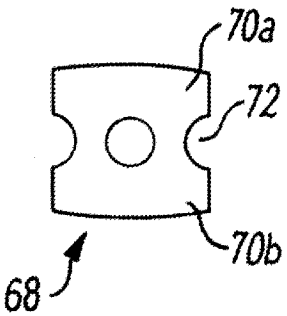
FIG. 9 is a side view of an alternative plate which may be used in accordance with an alternative embodiment of the invention.

FIG. 9 is an example of an alternative shape of plate, shown at 68, which may be used in the embodiments of the invention. In this embodiment, the inner portion 70*b* is with the same width as the outer portion 70*a*, and side recesses 72 are provided to accommodate an adjacent magnet assembly and allow the outer and inner portions of the plate to extend to the approximate mid-point of the adjacent assembly.

It will be appreciated that in alternative embodiments of the invention, other arrangements of plates may be used in order to mitigate the passage of drilling mud and magnetic swarf particles through the slot provided in the bulkhead. In some embodiments, the plates may be supplemented with additional protective elements such as a rubber skirt or apron arranged over the outer portion of the plates, which may function to generally direct flow away from the upper edges of the plates and towards the flow spaces 44.

Figure 10:
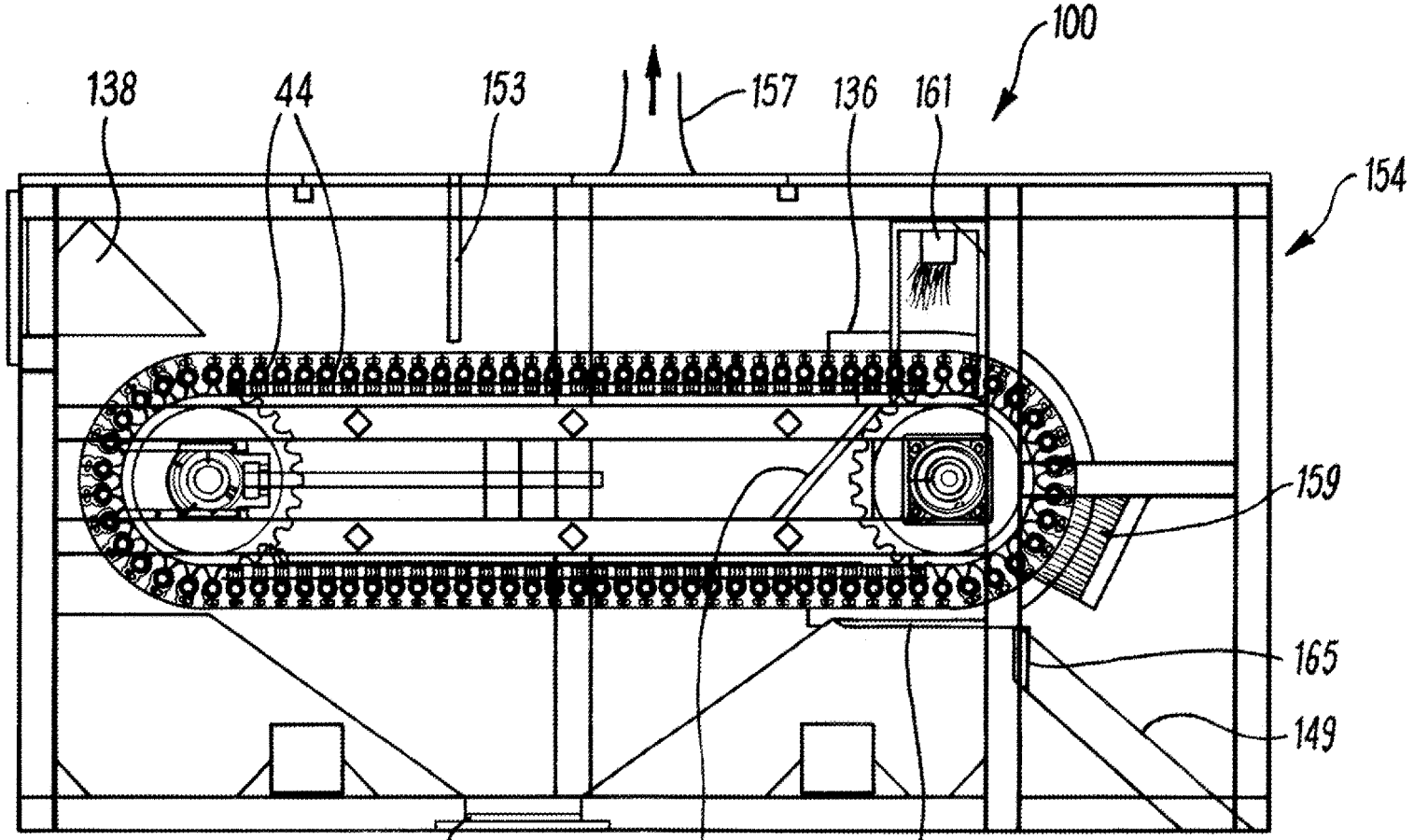
FIG. 10 is a schematic side view of an apparatus according to an alternative embodiment of the invention.

FIG. 10 is a side elevation of an apparatus according to an alternative embodiment of an invention. The apparatus shown generally at 100 is similar to the apparatus 10 of FIG. 1, and its operation will be understood from the foregoing description. However, the apparatus 100 comprises a number of additional features as described below.

The apparatus 100 is provided with deflecting means in the form of a rubber apron 153 which is supported by the frame and extends downwards towards the upper layer of the conveyor. The rubber apron 153 is located sufficiently close to the inlet 138 to direct fast moving flow of liquid being treated downwards towards the upper layer of the conveyor through the flow gaps 44. The rubber apron 153 mitigates against fluid passing directly from the inlet over the conveyor and into the collection end 154 of the apparatus. It will be appreciated that additional deflecting means may be provided in the apparatus.

The apparatus is provided with an extractor vent 157 which is coupled to an extractor fan (not shown). The extractor vent facilitates controlled evacuation of gaseous fumes from the processed liquid.

The apparatus 100 is also provided with an arrangement of fluid jets 161. This is supported by the frame above the upper layer of the conveyor towards to the collection end of the apparatus. The fluid jets are in this example air jets. The fluid jets are operated and used to direct air towards the magnet assemblies to assist in removing liquid content from the conveyor and directing it through flow gaps 144 towards the outlet 150. A flow directing member 163 facilitates the direction of the liquid towards the outlet 150, and mitigating against its passage towards the collection end. The fluid jets therefore reduce the liquid content passing into the collection skip.

Apparatus 100 also includes an arrangement of brushes for 159 disposed adjacent an outer surface of the conveyor at a collection end. The brushes contact the magnet assemblies while the magnets are in the retracted position, and assist in dislodging solid materials including swarf particles that adhered to the magnet assemblies. The dislodged solids then pass into the collection skip.

The apparatus 100 is also provided with a modified flow plate 149 and a swarf shelf 155. In use, the swarf shelf provides a supporting surface for material which is drawn through the apparatus by the motion of the conveyor, e.g. by a mechanical force. The shelf 155 therefore maintains material close to the conveyor. The shelf extends to a position beyond the point at which the magnet assemblies of the conveyor are moved into their extended positions. Therefore the magnetic field is activated in a region adjacent the shelf and is able to attract magnetic particles which have been drawn around the conveyor by mechanical forces. This attracts magnetic particles back onto the surface of the magnet assemblies and prevents them from falling towards the flow outlet 150. The magnetic particles will be carried around the conveyor for another cycle until the magnets are retracted in the collection location to enable the particles to fall towards the collection skip.

The modified flow plate 149 in this embodiment has a flow directing member with a pivot 165 which allows it to be redirected to one of a pair of adjacent collection skips. This allows skips to be filled sequentially with no or little interruption to the treatment process.

It will be appreciated that the features shown in FIG. 10 and/or described above may be used together or separately in different embodiments of the invention. Furthermore, the features shown are also compatible with alternative embodiments of the invention even when not expressly described herein.

Figure 11A:
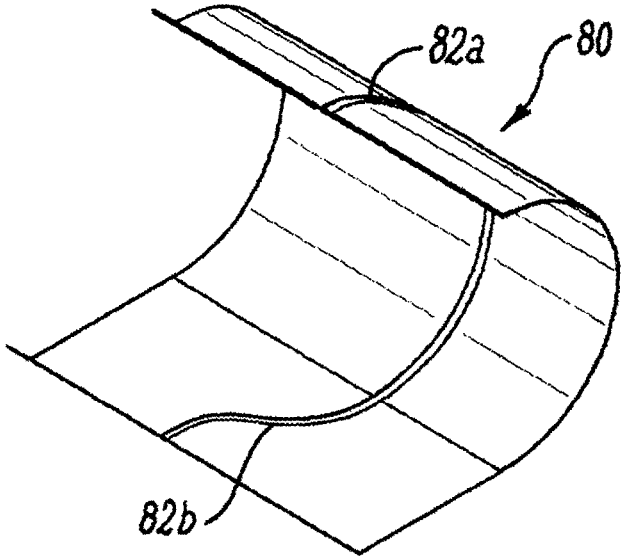
FIGS. 11A to 11C are respectively isometric, front, and side views of a guide plate used in an alternative embodiment of the invention.
Figure 11B:
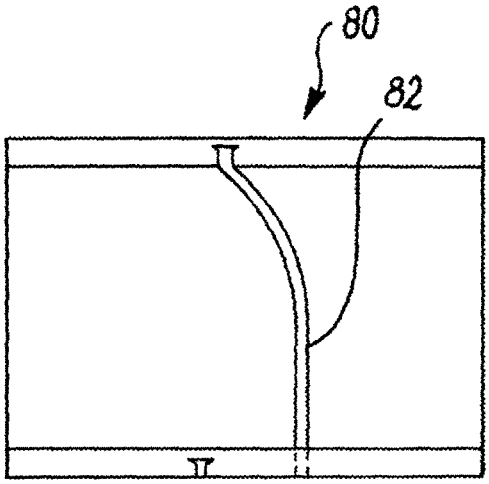
Figure 11C:
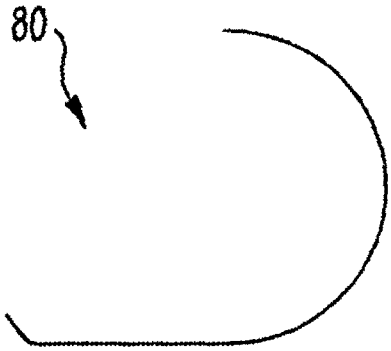

The above-described embodiments use a pair of rails 36 to guide the magnets between their active and inactive positions. FIGS. 11A to 11C show an alternative configuration, in which the guide is formed by a slot in a curved guide plate, shown generally at 80. The slot 82 follows a curved profile, similar to that provided by the guide rails 36 of the embodiment of FIG. 1. An opening to the slot 84 receives the bearing 34 of the magnet assembly, and the curved path in the upper part 82*a* of the slot causes the corresponding magnet to be retracted from the operating side into the drive side of the apparatus. A corresponding curved path in the lower part 82*b* of the slot returns the magnet to its extended position in the operating side.

Figure 12:
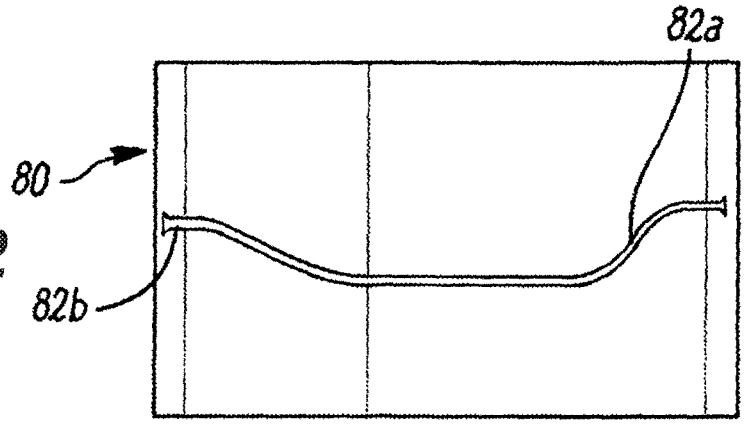
FIG. 12 is a view of the guide plate according to the embodiment of FIGS. 6A to 6C in a flattened state before forming.

FIG. 12 illustrates the advantages of the guide plate of FIGS. 11A, 11B, 11C. The guide plate can be formed from a flat sheet of material such as stainless steel, with the slot 82 formed in the flat sheet prior to bending the guide to the required shape (for example the shape shown in FIG. 11C).

Figure 13A:
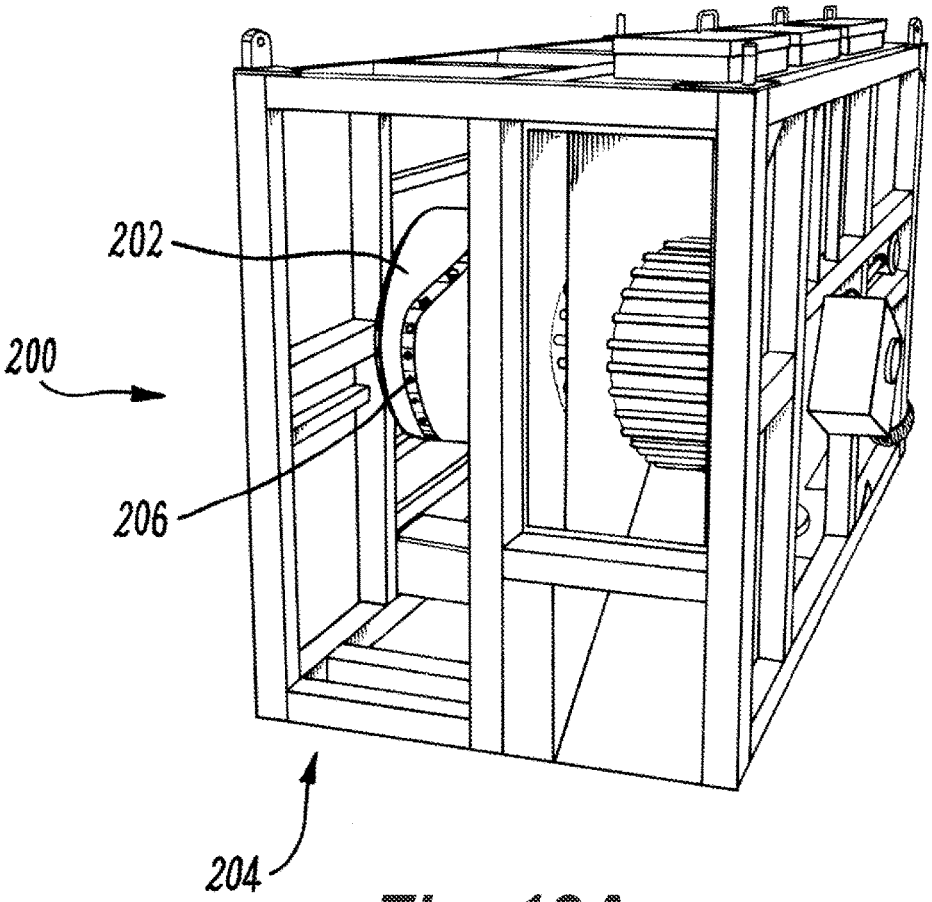
FIGS. 13A to 13C are perspective views of an apparatus according to an embodiment of the invention in which a guide plate is used to activate and deactivate the magnet in use.
Figure 13B:
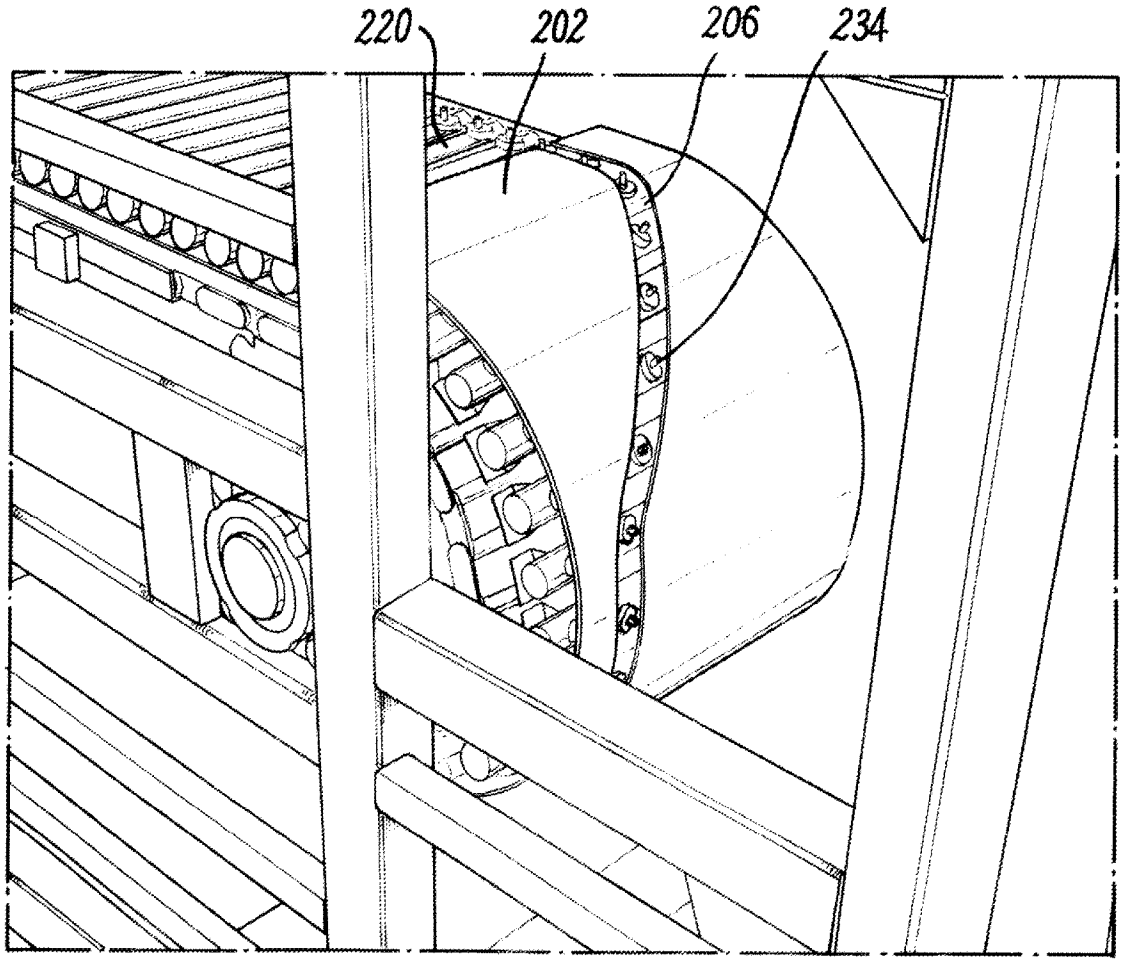
Figure 13C:
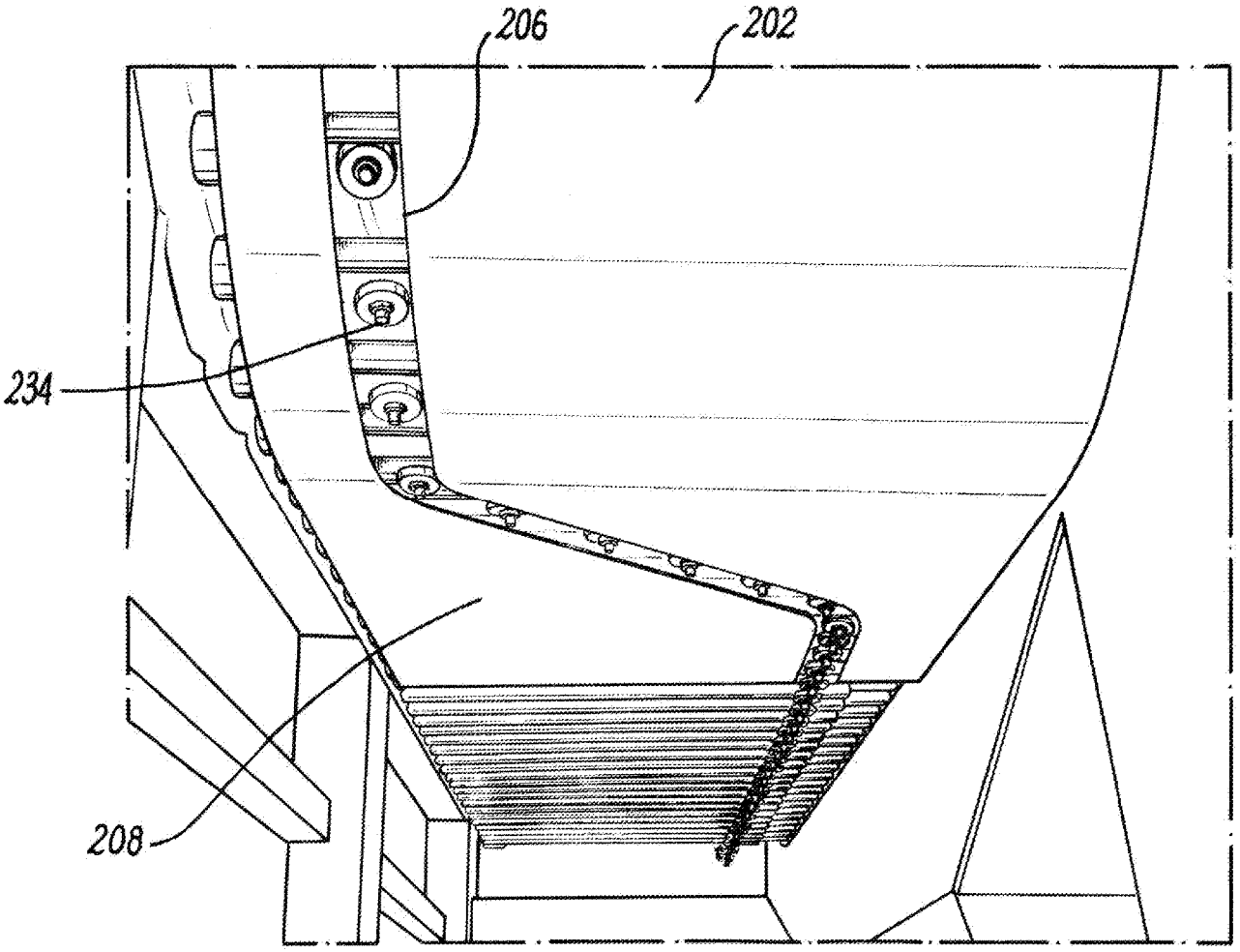

FIGS. 13A, 13B and 13C are perspective views of an apparatus 200, which is similar in structure and function to the apparatus 100, but which comprises a guide plate 202 similar to the guide plate 82 of FIGS. 11 and 12. The guide plate 202 is positioned at a collection end 204 of the apparatus, and comprises a slot 206 which receives a bearing portion 234 of the magnet assemblies 220 to retract the magnet within the housing towards the drive side. The bearing portion 234 and magnet assembly 220 follow the path of the slot, and on the lower surface 208 of the curved guide plate is redirected back into an extended position (i.e. with the magnet on the operating side 14) to reactivate the magnetic field. In variations to this embodiment, guide rails may be provided between the openings to the slot. Another variant may include a reinforced bearing surface or lip on one or both sides of the guide slot 206.

In the above-described embodiments of the invention, the magnet assemblies move as part of a conveyor, and are translated in relation to the bulkhead in a movement cycle. This arrangement provides flexibility in the shape and size of the conveyor path, and enables for example swarf particles to be collected at a collection location displaced laterally from the fluid outlet with relatively low height requirements. However, the embodiments do require the magnet assemblies to pass through a slot in the bulkhead, requiring careful mitigation of the passing of fluid through the bulkhead to avoid fluid and swarf particles passing into the drive side.

Figure 14B:
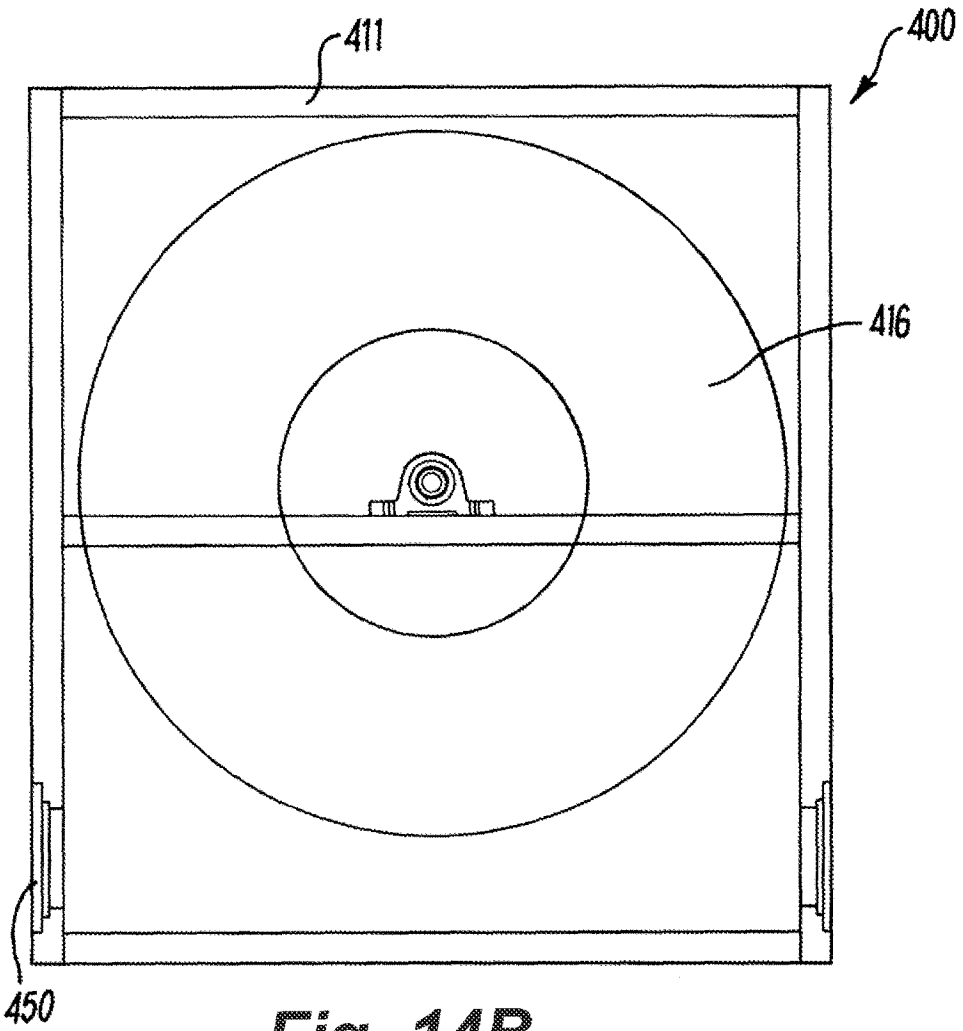
FIGS. 14A and 14B are respectively end and side views of an apparatus according to an alternative embodiment of the invention.
Figure 14A:
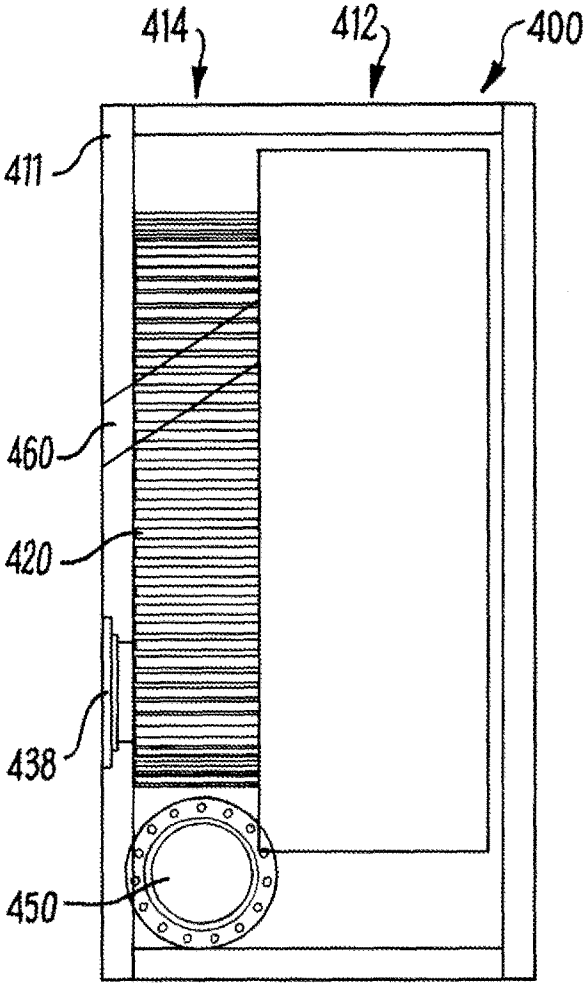
Figure 15B:
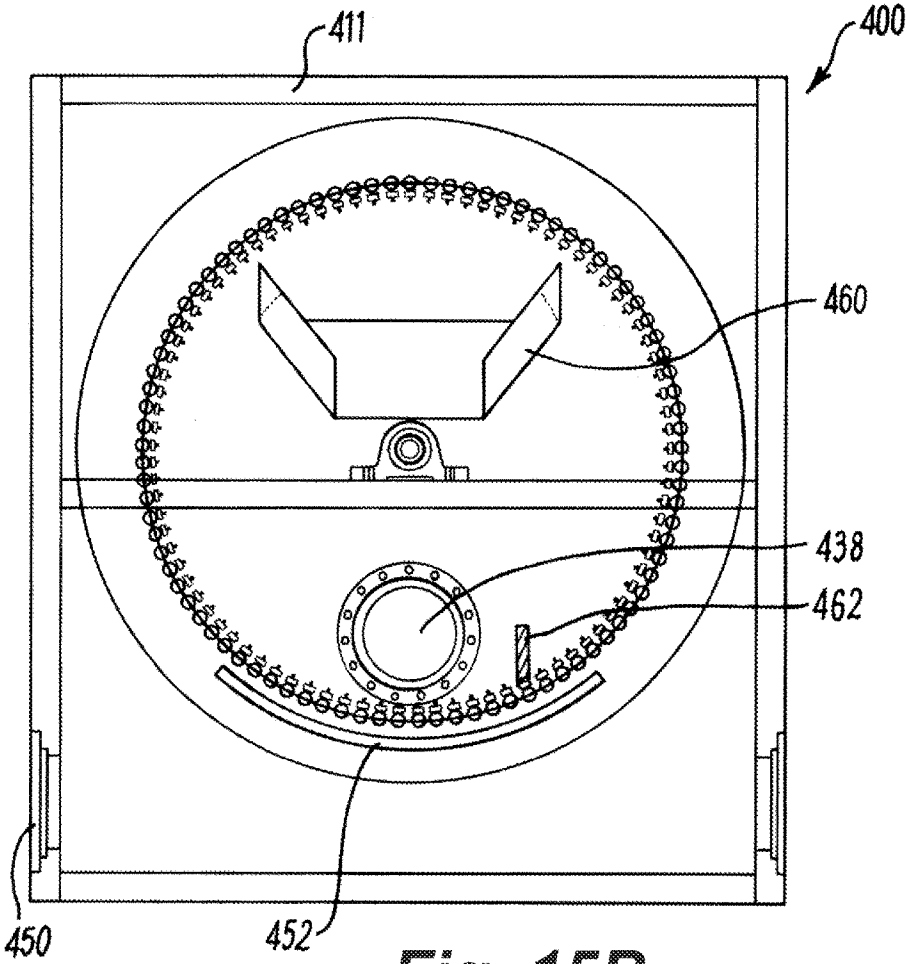
FIGS. 15A and 15B are respectively end and side views of the apparatus of FIG. 14 showing internal components.
Figure 15A:
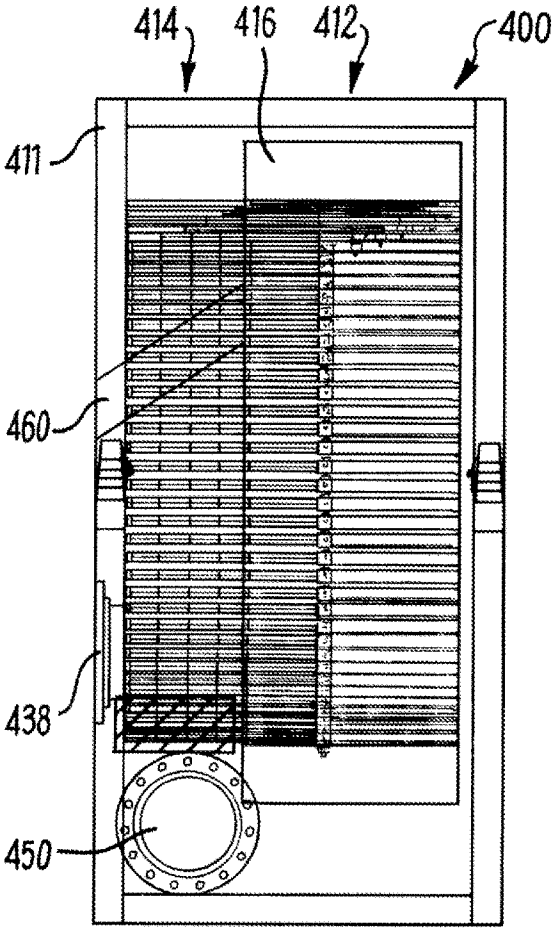

FIGS. 14A, 14B, 15A and 15B are views of an alternative embodiment of the invention, which is similar to the previous embodiments but which addresses the problem of passing of fluid or swarf through a gap in the bulkhead by sealing the magnet assemblies with respect to the bulkhead which is translated with the conveyor. FIGS. 14A and 14B are respectively end and side views of the apparatus, generally shown at 400, and FIGS. 15A and 15B are respectively end and side views of the apparatus 400 showing internal components.

The apparatus 400 comprises a frame 411 which supports a rotary assembly 416. The apparatus has a drive side 412 and an operating side 414. The rotary assembly 416 comprises a number of magnet assemblies 420, arranged as a continuous circular conveyor around a central shaft 422. The magnet assemblies 420 are similar to magnet assemblies 20, and will be understood from FIGS. 2 and 3 and the corresponding description. Each comprises a tubular housing 428 (in this example, cylindrical) formed from stainless steel, and an internal elongate magnet 430, slidable in the housing 428. Each magnet 430 comprises a formation 431 which protrudes through a slot 432 in the housing. In this case, the formation is a bearing 434, arranged to engage with a guide slot 436 in a guide plate 437 to slide the magnet within the housing.

Figure 16:
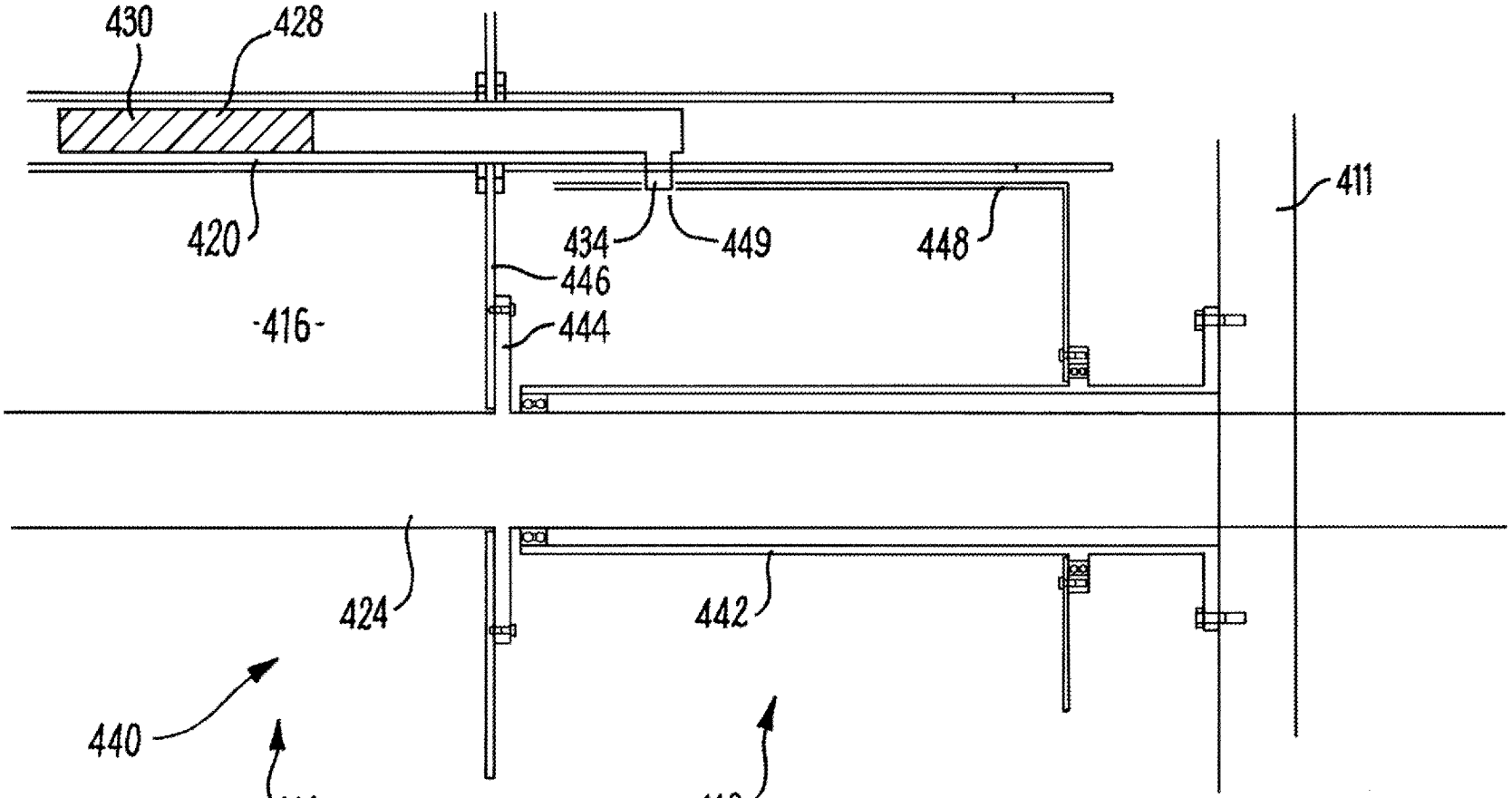
FIG. 16 is a schematic view of a mounting arrangement of the apparatus of FIGS. 14 and 15.

The mounting arrangement of the shaft 424 is shown schematically and in cross-section in FIG. 16, generally depicted at 440. The frame 411 supports a bearing sleeve 442 through which the rotary shaft 424 of the rotary assembly 416 extends. A flange plate 444 on the rotary shaft supports a planar bulkhead member 446, to which the housing components of magnet assemblies are joined. When the apparatus 400 is operating, the rotary shaft 424, planar bulkhead member 446 and magnet assemblies 420 rotate with respect to the bearing sleeve 442 and the frame.

Fixed to the bearing sleeve 442 in an upper segment of the rotary assembly 416 is a guide plate 448. The guide plate 448 is similar in function to the guide plates 80, 202 of the embodiments of FIGS. 11 to 13. The guide plate 448 comprises an opening and a slot 449 which guides a bearing portion 434 of a magnet to cause the longitudinal position of the magnets in the housing to be moved between an extended position (i.e. in the operating side and a retracted position (i.e. into the drive side). Therefore the guide plate 448 is arranged to cause the magnets to be cyclically retracted and extended into the operating side of the apparatus during rotation of the rotary assembly.

The apparatus 400 comprises an inlet 438 which delivers drilling mud or slurry to an interior volume of the operating side of the apparatus. As with the earlier embodiments of the invention, the conveyor formed by the magnet assemblies includes flow spaces which allow the passage of fluid between adjacent magnet assemblies and down towards an outlet 450. A flow baffle 452 impedes the downward flow of the drilling mud or slurry and increases the exposure time of the flow to magnet assemblies, until the extremities of the baffle are passed and the fluid flows towards the outlet 450.

The apparatus 400 comprises a collection chute 460 arranged in an upper part of the apparatus generally above the fluid inlet 438. The collection chute 460 directs material which falls onto it in an axial direction of the rotary assembly and towards a collection skip (not shown).

The apparatus 400 works in a similar manner to the apparatus of previous embodiments. The drive mechanism is switched on to cause the conveyor to run and move the rotary assembly. Inlet 438 delivers drilling mud or slurry into the operating side 414 of the apparatus. Gravity directs the flow of mud towards the conveyor, where it impinges on the magnet assemblies 420. As the mud passes through the apparatus, large solid particles are prevented from passing through the flow spaces, and are conveyed with movement of the conveyor, with the assistance of fingers 462 to the collection chute 460 in the upper part of the apparatus. Swarf particles in the mud are attracted to the surface of the housings 428 of the magnet assemblies 420 and are carried on the outer surface of the housings towards the collection chute 460. As each magnet assembly 420 approaches the collection chute, the bearings 434 of the magnet assemblies 420 contact the guide plate 448, and continued movement of the magnet assemblies causes the respective magnet 430 to slide in the housing 428 away from the operating side 414, so that it is retracted into the drive side 412. The magnetic field is therefore deactivated from the operating side, and the attractive force which retained the swarf particles on the magnet assemblies is no longer present. The magnetic particles fall by gravity towards the collection chute 460 and into the collection skip. On the return cycle the magnets are forced to slide back inside the housing to extend into the operative part of the housing.

The apparatus 400 has the additional benefit that there is no translational movement of the magnet assemblies or conveyors with respect to the bulkhead which separates the operating and drive sides. Instead, the bulkhead is joined to the magnet assemblies and may be sealed therewith to eliminate a potential flow path for swarf particles away from the operating side. This is facilitated by the rotational symmetry of the conveyor path. The apparatus has the additional benefit of a small footprint, and a relatively high starting position for the collection chute, which mitigates the need to raise the working height of the apparatus to a position above a standard collection skip.

Figure 17:
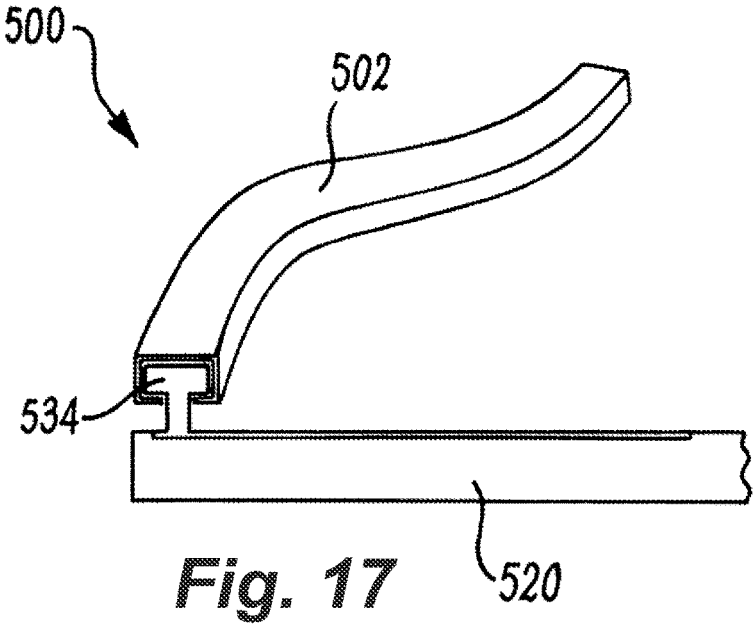
FIG. 17 is a schematic view of a guide arrangement according to an alternative embodiment of the invention.
Figure 18:
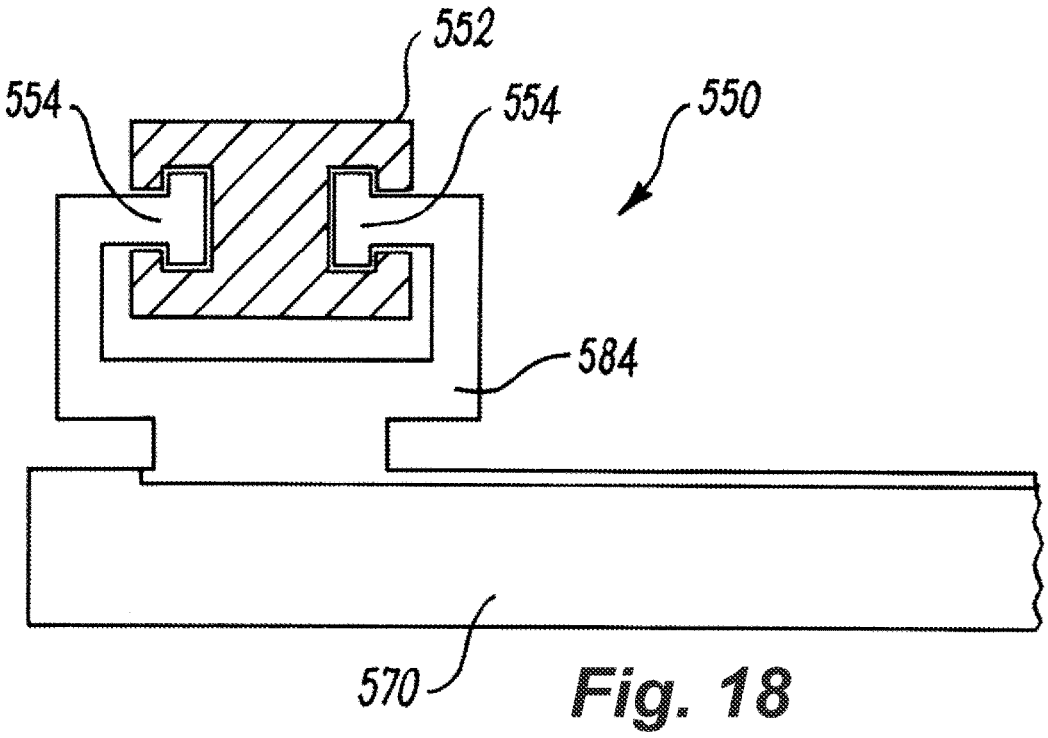
FIG. 18 is a schematic view of a guide arrangement according to a further alternative embodiment of the invention.

It will be appreciated that a variety of means may be used to retract and extend the magnet assemblies according to different embodiments of the invention. For example, FIG. 17 is a schematic view of an alternative embodiment of the invention, shown generally at 500, in which an internal bearing surface of a curved rail 502 is used to guide a bearing 534 of a magnet assembly 520. FIG. 18 is a schematic sectional view of an alternative embodiment of the invention, shown generally at 550, in which a curved rail 552 comprises channels which receive roller guides 554 mounted on a bearing 584 of a magnet assembly 570.

Further non-illustrated embodiments may be used with the invention. For example, the cyclical extension and retraction of magnets within magnet assemblies may be driven by pneumatic actuation to change the position of the magnet. Such a configuration is particularly suited to the rotary assembly described with reference to FIGS. 14 and 15, as this system facilitates positional registration of pneumatic actuation valves. In another variation, a magnetic track or sequence of magnets may be placed externally to the housings of the magnet assemblies, to magnetically draw the magnet assemblies towards their extended or retracted positions. One advantage of the pneumatic or magnetic systems described above is that they enable the magnet assemblies to be sealed on the drive side and the operating side of the apparatus, reducing the risk of swarf particles fouling the drive mechanism.

The invention provides an apparatus for removing magnetic particles from a liquid flowing from an oil or gas operation and method of use. The apparatus comprises a plurality of magnet assemblies, each having a first condition in which an operable part is active to attract magnetic particles to the magnet assembly, and a second condition in which the operable part is inactive and magnetic particles are not attracted to the magnet assembly. A drive mechanism moves the magnet assemblies between exposure to a flow path of from a liquid flowing from an oil or gas operation and a collection location. An activation means moves the magnet assemblies between the first condition and the second condition.

Various modifications may be made within the scope of the invention as herein intended, and embodiments of the invention may include combinations of features other than those expressly claimed.

The invention claimed is:

1. An apparatus for separating non-magnetic solid particles and magnetic swarf particles from a liquid flowing from an oil or gas operation, the apparatus comprising:

a plurality of magnet assemblies defining an array which traverses a flow path of a liquid from an oil or gas operation, wherein the magnetic assemblies are spatially separated to provide flow spaces between adjacent magnetic assemblies, each magnet assembly having a first condition in which an operable part of the magnet assembly is active to attract magnetic particles to the magnet assembly, and a second condition in which the operable part of the magnet assembly is inactive and magnetic particles are not attracted to the magnet assembly;

a drive mechanism for moving the magnet assemblies between a position in which they are exposed to the liquid and a collection location;

wherein the apparatus comprises an activation means which is configured to move the magnet assemblies between the first condition when exposed to the liquid and the second condition when at the collection location, characterised in that the plurality of magnetic assemblies are arranged as a conveyor for non-magnetic solid particles wherein movement of the conveyor mechanically conveys non-magnetic solid particles in the liquid to the collection location.

2. The apparatus according to claim 1, wherein the magnet assembly comprises a housing and a magnet, and the activation means comprises a mechanism which is configured to move a magnet contained in the housing relative to the housing.

3. The apparatus according to claim 2, wherein the housing is an elongate housing oriented in a direction perpendicular to a direction of movement of the magnet assembly.

4. The apparatus according to claim 2, wherein adjacent magnets in adjacent magnet assemblies are arranged with opposing poles facing one another.

5. The apparatus according to claim 4, wherein the poles of the magnets are arranged vertically.

6. The apparatus according to claim 1, wherein the drive mechanism is configured to operate the activation means.

7. The apparatus according to claim 6, wherein a first part of the housing forms the operable part of the magnet assembly, and the operable part of the magnet assembly is separated from the activation means.

8. The apparatus according to claim 6, wherein the activation means comprises a mechanism for imparting a sliding motion to the magnet, relative to the housing of the magnet assembly.

9. The apparatus according to claim 1, wherein the activation means comprises a guide and formation on the magnet for engaging the guide.

10. The apparatus according to claim 9, wherein the formation on the magnet contacts the guide, such that movement of the magnet assembly in a direction inclined to the guide causes the magnet to slide in the housing.

11. The apparatus according to claim 10, wherein the formation comprises a bearing.

12. The apparatus according to claim 9, wherein the guide comprises a rail or a slot.

13. The apparatus according to claim 9, wherein each magnet assembly comprises a housing and a magnet, and wherein the housing comprises a slot through which the formation extends.

14. The apparatus according to claim 1, wherein the magnet assemblies are arranged horizontally and define a vertical flow path therethrough.

15. The apparatus according to claim 1, wherein the liquid is gravity fed through the plurality of magnet assemblies.

16. The apparatus according to claim 1, wherein the magnet assemblies define two arrays or layers which traverse the flow path.

17. The apparatus according to claim 16, wherein the magnet assemblies of the first and second arrays or layers are in the first condition where they traverse the flow path.

18. The apparatus according to claim 1, comprising a dividing screen separating the operable parts of the magnet assemblies from the activation means.

19. The apparatus according to claim 18, wherein the dividing screen comprises one or more sheets, oriented in a plane aligned in the direction of movement of the magnet assemblies.

20. The apparatus according to claim 18, wherein the magnet assemblies extend through a slot in the dividing screen.

21. The apparatus according to claim 20, wherein the magnet assemblies comprise one or more plates covering the slot in the dividing screen.

22. The apparatus according to claim 21, wherein the magnet assemblies comprise a pair of plates, each plate of the pair on an opposing side of the dividing screen.

23. The apparatus according to claim 22, wherein adjacent plates on adjacent magnet assemblies are arranged to overlap one another.

24. The apparatus according to claim 18, comprising first and second dividing screens which are spatially separated.

25. The apparatus according to claim 1, wherein the magnet assemblies are arranged to cause each adjacent pair of magnet assemblies to generate first and second magnetic fields.

26. The apparatus according to claim 1, comprising a conveyor path of magnet assemblies which is rotationally symmetrical.

27. The apparatus according to claim 26, wherein each magnet assembly comprises a housing and a magnet, and wherein the magnet assemblies and/or the housings of the magnet assemblies are fixed with respect to a dividing screen.

28. The apparatus according to claim 26, wherein the apparatus is sealed against the passage of fluid and/or swarf from the operating side of the apparatus.

29. The apparatus according to claim 26, comprising a substantially circular conveyor path and/or arrangement of magnet assemblies.

30. The apparatus according to claim 26, comprising an inlet for delivering a liquid from an oil or gas operation to an interior of the conveyor path.

31. The apparatus according to claim 26, comprising a fluid outlet for receiving fluid from an exterior of the conveyor path.

32. The apparatus according to claim 26, comprising a collection chute configured to receive solids and/or magnetic swarf particles, the collection chute located at least partially in the interior of the conveyor path.

33. The apparatus according to claim 32, wherein the collection chute is located at an upper segment of the conveyor path.

34. The apparatus according to claim 33, wherein the collection chute is located at a position higher than or above the inlet.

35. The apparatus according to claim 26, comprising a formation for mechanically moving or lifting solid particles towards a collection location.

36. The apparatus according to claim 35, wherein the formation comprises one or more fingers.

37. The apparatus according to according to claim 1, wherein the conveyor is configured to convey non-magnetic solid particles too large to pass through the flow spaces to the collection location.

38. The apparatus according to according to claim 1, wherein the conveyor is configured to convey non-magnetic solid particles resting on the conveyor to the collection location.

39. An oil or gas exploration or production facility comprising the apparatus of claim 1.

40. A method of separating non-magnetic solid particles and magnetic swarf particles from a liquid flowing from an oil or gas operation, the method comprising:

providing a plurality of magnet assemblies which define an array which traverses a flow path of a liquid from an oil or gas operation, wherein the magnet assemblies are spatially separated to provide flow spaces between adjacent magnet assemblies;

exposing the magnet assemblies to the flow path of the liquid while a subset of the magnet assemblies is in a first condition in which an operable part of the magnet assembly is active to attract magnetic particles to the magnet assembly;

using a drive mechanism to move the magnet assemblies between a position in which they are exposed to the liquid and a collection location; using an activation means to move the magnet assemblies to a second condition in which the operable part of the magnet assembly is inactive and magnetic particles are not attracted to the magnet assembly; and releasing the magnetic particles to a collection device;

characterised in that movement of the magnet assemblies mechanically conveys non-magnetic solid particles in the liquid to the collection location.

41. The method according to claim 40 comprising rotating a rotary assembly comprising the magnet assemblies.

42. The method according to claim 41 comprising moving a magnet contained in the magnet assembly relative to a housing of the magnet assembly.

43. The method according to claim 42 comprising moving the magnet relative to the housing in a direction perpendicular to the movement of the magnet assembly.

44. The method according to claim 42 comprising contacting a formation on the magnet with a guide, such that movement of the magnet assembly in a direction inclined to the guide causes the magnet to slide in the housing.

45. The method according to claim 41 comprising arranging the magnet assemblies horizontally and passing the liquid through a substantially vertical flow path between the magnet assemblies.

46. The method according to claim 40 comprising moving the magnet assembly in a direction perpendicular to a direction of an elongate axis of the magnet assemblies.

47. The method according claim 40 comprising gravity feeding the liquid through the plurality of magnet assemblies.

48. The method according to claim 40 comprising mechanically moving or lifting solid particles towards a collection location by a formation of the apparatus.

49. The method according to claim 40 comprising conveying non-magnetic solid particles too large to pass through the flow spaces to the collection location.

50. The method according to claim 40 comprising conveying non-magnetic solid particles resting on the magnet assemblies to the collection location.

* * * * *